US012098497B2

(12) United States Patent
Roh et al.

(10) Patent No.: US 12,098,497 B2
(45) Date of Patent: Sep. 24, 2024

(54) CLOTHING TREATMENT APPARATUS

(71) Applicant: LG ELECTRONICS INC., Seoul (KR)

(72) Inventors: Jeongjoon Roh, Seoul (KR); Jihyun Yoon, Seoul (KR); Ayeong Lee, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 499 days.

(21) Appl. No.: 17/310,873

(22) PCT Filed: Feb. 28, 2020

(86) PCT No.: PCT/KR2020/002916
§ 371 (c)(1),
(2) Date: Aug. 27, 2021

(87) PCT Pub. No.: WO2020/175964
PCT Pub. Date: Sep. 3, 2020

(65) Prior Publication Data

US 2022/0127778 A1 Apr. 28, 2022

(30) Foreign Application Priority Data

Feb. 28, 2019 (KR) ..... 10-2019-0024364

(51) Int. Cl.
*D06F 73/02* (2006.01)
*D06L 1/12* (2006.01)

(52) U.S. Cl.
CPC ..... *D06F 73/02* (2013.01); *D06L 1/12* (2013.01)

(58) Field of Classification Search
CPC ..... D06L 1/12; D06F 73/02
See application file for complete search history.

(56) References Cited

U.S. PATENT DOCUMENTS 3,049,903 A * 8/1962 Sussman ..... D06F 87/00 68/12.26
3,805,561 A * 4/1974 Bullock ..... D06F 73/02 223/51

(Continued)

FOREIGN PATENT DOCUMENTS

CN 106012481 A 10/2016
CN 108611828 A 10/2018

(Continued)

OTHER PUBLICATIONS

Machine Translation of KR 101710392 B1 to Lee et al. (Year: 2017).*

(Continued)

*Primary Examiner* — Benjamin L Osterhout
(74) *Attorney, Agent, or Firm* — Birch, Stewart, Kolasch & Birch, LLP

(57) ABSTRACT

A clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while locating inside the receiving space, a rotation motor configured to rotate the steamer so that the steamer is in contact with the clothing, and an elevating motor configured to elevate the steamer in a state where the steamer is in contact with the clothing.

The steamer may include a front steam body formed long in the left and right direction and in contact with the front surface of the clothing, and a rear steam body spaced apart from the front steam body, formed long in the left and right direction, and in contact with the rear surface of the clothing.

18 Claims, 26 Drawing Sheets

(56) References Cited

U.S. PATENT DOCUMENTS

| | | | | |
|---|---|---|---|---|
| 3,861,179 | A * | 1/1975 | Orchard | D06F 73/02 68/6 |
| 9,010,158 | B2 * | 4/2015 | Yoo | D06F 58/10 68/5 R |
| 9,790,638 | B2 * | 10/2017 | Song | D06F 58/10 |
| 11,319,664 | B2 * | 5/2022 | Chang | D06F 58/203 |
| 11,821,137 | B2 * | 11/2023 | Shin | D06F 73/02 |
| 2010/0043500 | A1 * | 2/2010 | Yoo | D06F 73/02 68/5 C |
| 2010/0058813 | A1 * | 3/2010 | Moon | D06F 73/02 68/6 |
| 2010/0180645 | A1 * | 7/2010 | Kim | D06F 73/02 68/5 C |
| 2012/0160269 | A1 * | 6/2012 | Pyo | D06F 58/44 134/25.1 |
| 2012/0317729 | A1 | 12/2012 | Song et al. | |
| 2013/0104316 | A1 * | 5/2013 | Kappler | D06F 33/36 8/137 |
| 2017/0327306 | A1 * | 11/2017 | Nam | B65D 85/18 |
| 2018/0148887 | A1 | 5/2018 | Choi et al. | |
| 2019/0017219 | A1 | 1/2019 | Song et al. | |
| 2020/0040504 | A1 | 2/2020 | Rochford et al. | |

FOREIGN PATENT DOCUMENTS

| | | | |
|---|---|---|---|
| JP | 2008-183101 | A | 8/2008 |
| JP | 2017-86138 | A | 5/2017 |
| KR | 10-2007-0109319 | A | 11/2007 |
| KR | 10-2009-0059358 | A | 6/2009 |
| KR | 10-2011-0099914 | A | 9/2011 |
| KR | 10-2015-0078400 | A | 7/2015 |
| KR | 10-2017-0010392 | B1 | 2/2017 |
| KR | 101710392 | B1 * | 2/2017 |
| KR | 10-2018-0037459 | A | 4/2018 |
| KR | 10-2018-0052956 | A | 5/2018 |

OTHER PUBLICATIONS

International Search Report dated Jun. 11, 2020, issued in related International Patent Application No. PCT/KR2020/002916 (4 pages).

* cited by examiner

CLOTHING TREATMENT APPARATUS

TECHNICAL FIELD

The present disclosure relates to a clothing processing apparatus, and more particularly, to a clothing processing apparatus for refreshing clothing.

BACKGROUND

In general, a washing machine is widely used as a device for washing articles made of fabrics such as clothing or bedding, and the washing machine washes the clothing through friction between the clothing water and the clothing received in a water tank, so that separate dehydration, drying process, and the like were additionally required.

Recently, as a device for processing or managing clothing more conveniently than the conventional washing machine, there are clothing processing apparatus are used, which has functions such as removing wrinkles from clothing or removing dust or odors from clothing without a separate washing process through washing water.

In Prior Document 1 (KR 10-2011-0099914A), a method for spraying steam close to clothing is employed, and it was attempted to minimize the loss of clothing through the ball member in a case where the clothing and the spray device come into contact. However, there is a problem in that the clothing does not spread taut because mechanical force is not applied to the clothing.

In Prior Document 2 (KR10-2018-0037459A), a method for spraying compressed air to spread the wrinkles of clothing is employed. However, for this purpose, additional parts such as a compressed air generator and a hose according to this are required, so that the size of the clothing processing apparatus increases and the cost thereof increases.

In Prior Document 3 (KR 10-2015-0078400A), a method for spraying steam close to clothing is employed. However, as in Prior Document 1, the mechanical force is not applied to the clothing, so that the clothing is not spread taut. In addition, since the clothing has to be placed on a floor frame, there is a risk that the clothing may be ironed with wrinkles occurring.

SUMMARY

Technical Problem

An object to be solved by the present disclosure is to provide a clothing processing apparatus that minimizes folds and wrinkles of clothing by performing refreshing in a state where mechanical force is applied to clothing.

Another object to be solved by the present disclosure is to provide a clothing processing apparatus having a simple configuration and a compact size.

The clothing processing apparatus according to an embodiment of the present disclosure may apply a mechanical force to clothing in a simple manner in which the steamer rotates, and may spray steam on the clothing while lowering. Accordingly, while the clothing processing apparatus is compact, folds or wrinkles of clothes can be effectively removed.

In more detail, a clothing processing apparatus according to an embodiment of the present disclosure may include a cabinet having a receiving space formed therein, in which clothing is received, a holder configured to be located in the receiving space to hold a clothing supporter configured to support the clothing, a steamer configured to spray steam toward the clothing while locating inside the receiving space, a rotation motor configured to rotate the steamer so that the steamer is in contact with the clothing, and an elevating motor configured to elevate the steamer in a state where the steamer is in contact with the clothing. The steamer may include a front steam body formed long in the left and right direction and in contact with the front surface of the clothing, and a rear steam body spaced apart from the front steam body, formed long in the left and right direction, and in contact with the rear surface of the clothing.

The steamer may have a single closed curve shape.

A plurality of steam spraying parts may be formed on the front steam body and the rear steam body.

The elevating motor may lower the steamer in a state where at least a portion of the front steam body and the rear steam body overlaps each other in the vertical direction.

A steam injector into which steam is injected may be rotatably fastened to the front steam body and the rear steam body.

The steam injectors may be fastened to the central portions of the front steam body and the rear steam body.

Stopper grooves having a predetermined length in the circumferential direction may be formed on the front steam body and the rear steam body, and the steam injector may have a stopper protrusion configured to move in the stopper groove.

The steamer may further include a front connection part formed long in a forward inclined direction from an end portion of the front steam body, a rear connection part formed long in a direction parallel to the front connection part from an end portion of the rear steam body, a front auxiliary body formed long from the end portion of the front connection part toward the side surface of the cabinet, a rear auxiliary body formed long from an end portion of the rear connection part toward a side surface of the cabinet, and an outer connection part configured to connect end portions of the front auxiliary body and the rear auxiliary body.

The front connection part and the rear connection part may be formed to be steeper than the outer connection part.

The rotation motor may be connected to a central portion of the outer connection part.

The front and rear distance between the front auxiliary body and the rear auxiliary body may be greater than the front and rear distance between the front steam body and the rear steam body.

The clothing processing apparatus may further include a guide bar configured to be fixed long inside the cabinet in the vertical direction to guide the elevation of the steamer, a guide block having a groove into which the guide bar is fitted formed therein, and a rotation motor bracket configured to be fastened to the guide block and to be mounted with the rotation motor.

A coupler passing hole may be formed in the rotation motor bracket through which a coupler connecting the rotation motor and the steamer passes.

The clothing processing apparatus may further include a lead screw configured to be disposed long in the inner portion of the cabinet in the vertical direction and to be connected to the rotation motor, in which a screw hole through which the lead screw passes may be formed on the rotation motor bracket.

The clothing processing apparatus may further include a guide bar configured to be fixed long inside the cabinet in the vertical direction to guide the elevation of the steamer, a guide block having a groove into which the guide bar is fitted formed therein, and a connector configured to be fastened to the guide block and to which the steamer is rotatably connected.

The clothing processing apparatus may further include a limit switch configured to be mounted on the connector and to be pressed by the steamer.

The clothing processing apparatus may further include a controller configured to stop the rotation motor when the steamer presses the limit switch.

A method for controlling a clothing processing apparatus according to an embodiment of the present disclosure may include a lifting step in which a steamer including a front steam body and a rear steam body positioned opposite to each other with clothing interposed therebetween is lifted to a predetermined height, a rotation step in which the steamer rotates so that the front steam body is in contact with the front surface of the clothing and the rear steam body is in contact with the back surface of the clothing, and a lowering step in which the steamer sprays steam while lowering in a state where the front steam body and the rear steam body are in contact with the clothing.

The method for controlling a clothing processing apparatus may further include a preparatory step which is carried out before the elevating step and rotates the steamer until the limit switch is pressed.

In the lowering step, at least a portion of the front steam body and the rear steam body may overlap in the vertical direction.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, specific embodiments of the present disclosure will be described in detail with drawings.

In the present specification, a refresher for refreshing clothing as a clothing processing apparatus is described, but the present disclosure is not limited thereto and the inventive concept may be applied to other devices that may include a heat pump to be described later.

Here, the term "refresh" may mean a process of performing removing wrinkles, deodorizing, sanitizing, preventing static electricity, warming of clothing or the like by supplying air, heated air, or the like to clothing or providing water, mist, steam, or the like (hereinafter collectively referred to as 'steam' for convenience) to clothing. In addition, the clothing referred to in this specification includes not only clothing and apparel, but also objects that can be worn by a person, such as shoes, socks, gloves, hats, and scarves, as well as objects that can be used by a person such as dolls, towels, and blankets, and includes all objects that can perform washing.

Figure 1:
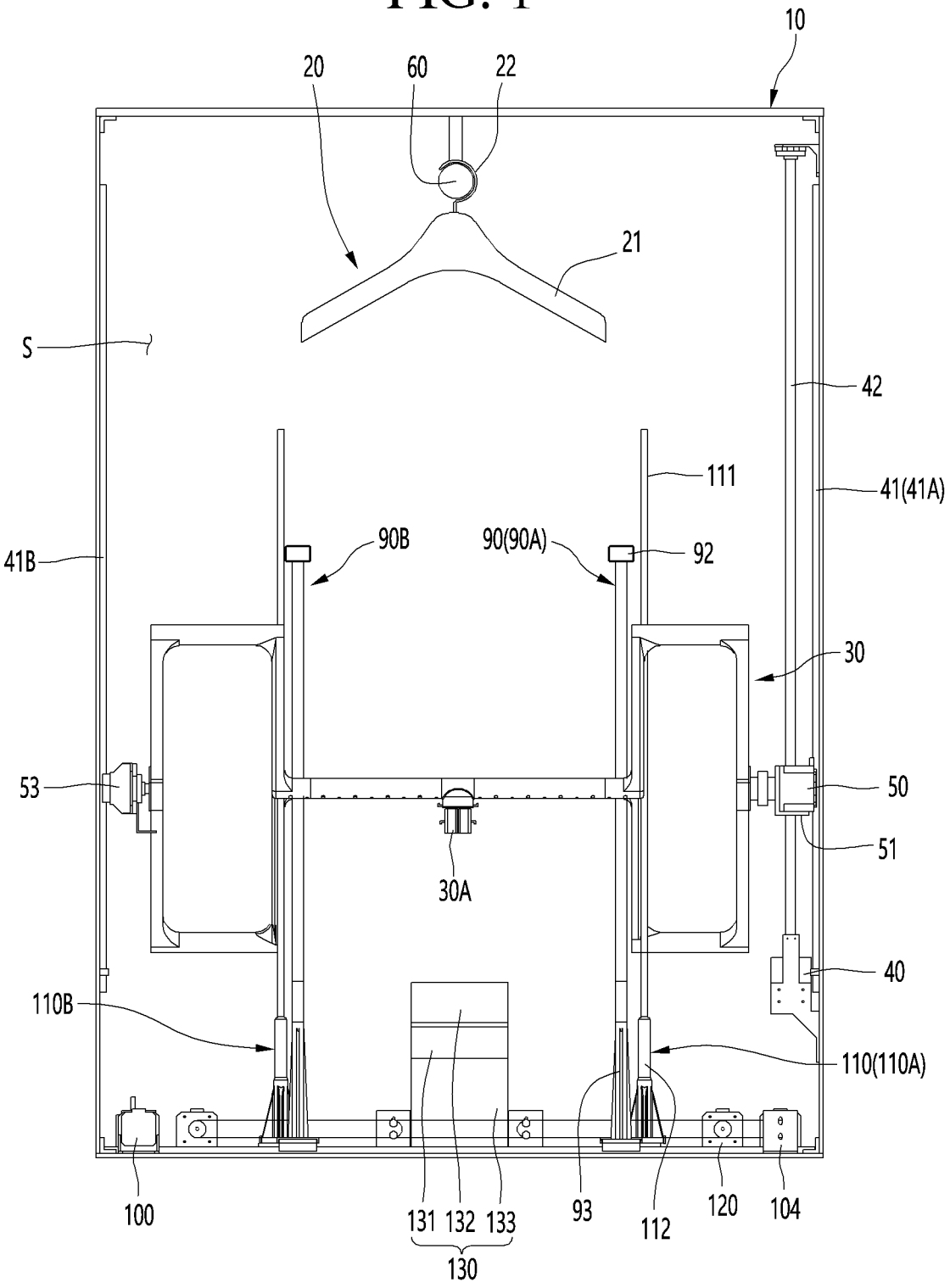
FIG. 1 is a front view illustrating a clothing processing apparatus according to an embodiment of the present disclosure.
Figure 2:
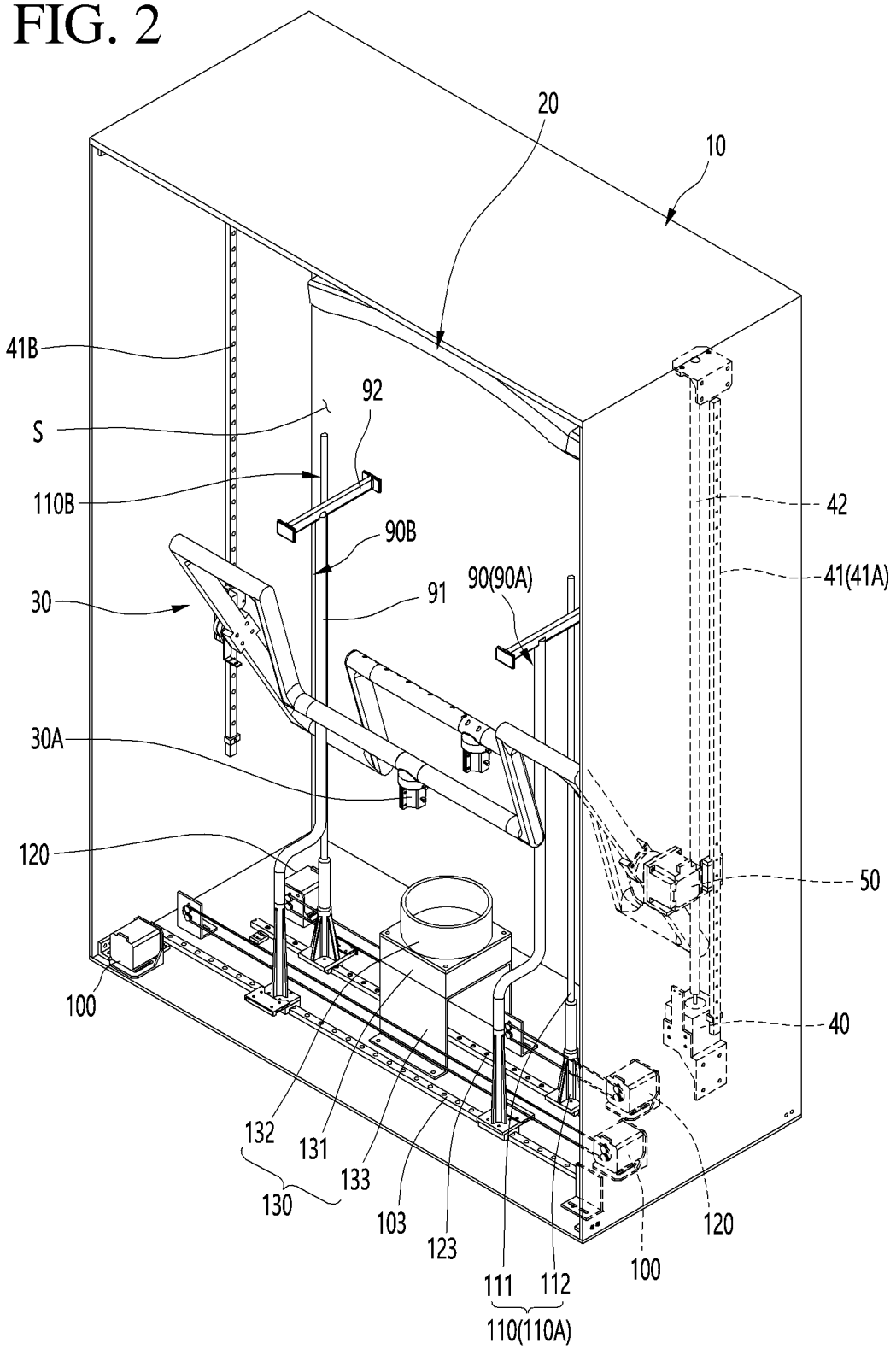
FIG. 2 is a perspective view illustrating a clothing processing apparatus according to an embodiment of the present disclosure.

FIG. 1 is a front view illustrating a clothing processing apparatus according to an embodiment of the present disclosure, and FIG. 2 is a perspective view illustrating a clothing processing apparatus according to an embodiment of the present disclosure.

The clothing processing apparatus according to the present embodiment may include a cabinet 10 in which a receiving space S for receiving clothing is formed.

The cabinet 10 may form the outer appearance of the clothing processing apparatus. The cabinet 10 may have a substantially rectangular box shape but is not limited thereto.

The clothing processing apparatus may further include a machine room (not illustrated). The machine room may be located inside or outside the cabinet 10. In a case where the machine room is located inside the cabinet 10, the machine room may be partitioned from the receiving space S. A plurality of devices including a steam generator (not illustrated) may be disposed in the inner portion of the machine room.

The steam generator may include a predetermined housing for storing water or passing water and a heater for heating the water in the housing. Accordingly, the steam generator can supply steam to the steamer 30 to be described later by heating water by the heater.

The clothing processing apparatus according to the present embodiment may include a holder 60 on which the clothing supporter 20 is held.

The holder 60 may be located in the receiving space S. The holder 60 may be supported by being fastened to or suspended from the upper portion of the cabinet 10. The holder 60 may be formed long in a front and rear direction. The holder 60 may have a circular bar shape.

The clothing supporter 20 may be held on the holder 60. The clothing supporter 20 may support the clothing C (see FIG. 13A). The clothing supporter 20 may be referred to as a clothing hanger.

In more detail, the clothing supporter 20 may include a hanging part 21 on which clothing is hung and a ring 22 for suspending the hanging part 21 on the holder 60.

The hanging part 21 may be disposed long in the left and right direction. The upper end of the hanging part 21 may be inclined in a direction in which the height decreases as the distance from the ring 22 increases. Clothing may be hung and supported on the upper end of the hanging part 21.

The ring 22 may be provided at the top center of the hanging part 21. The ring 22 may be hung on the holder 60.

A sensor (not illustrated) for determining whether the clothing supporter 20 is held may be provided on the holder 60.

For example, a groove (not illustrated) into which the ring 22 is fitted may be formed in the holder 60, and the sensor may include a light-emitting part located at one side of the groove and a light-receiving part located at the other side of the groove. When the ring 22 of the clothing supporter 20 is fitted into the groove, the light emitted from the light-emitting part is blocked by the ring 22, so that no light is incident on the light-receiving part. Accordingly, the sensor may detect that the clothing supporter 20 is held.

The clothing processing apparatus may include a steamer 30 to which steam is sprayed and an elevating motor 40 for elevating the steamer 30 in the vertical direction. The clothing processing apparatus may further include a rotation motor 50 for rotating the steamer 30.

The steamer 30 may be formed to be substantially long in the left and right direction. The steamer 30 may be located in the receiving space S of the cabinet 10. The steamer 30 may be movable in the vertical direction and may be constrained in the front and rear direction and the left and right direction.

The steamer 30 may have a single closed curve shape, and the clothing C supported by the clothing supporter 20 may pass through the inner portion of the steamer 30.

The steamer 30 may refresh the clothing C by spraying steam toward the clothing C supported by the clothing supporter 20. In more detail, the steamer 30 can elevate in the vertical direction to scan the clothing C and spray steam to the clothing C at the same time as the scan, so that the wrinkles of the clothing C can be effectively spread.

The steamer 30 may be provided with a steam injector 30A. The steam injector 30A may be connected to the above-described steam generator (not illustrated) by a steam hose (not illustrated). Accordingly, the steam generated by the steam generator may flow into the steamer 30 through the steam injector 30A.

The steamer 30 may be elevated in the vertical direction by the elevating motor 40.

The elevating motor 40 may be disposed on inner surfaces of the cabinet 10 in the left and right direction. The elevating motor 40 may be connected to at least one of both ends of the lead screw 42. For example, the elevating motor 40 may be connected to the lower end of the lead screw 42.

The elevating motor 40 can rotate the lead screw 42 disposed long in the vertical direction, and a screw hole 51E through which the lead screw 42 is fastened to a rotation motor bracket 51 to be described later (see FIG. 7) can be formed. A female thread corresponding to the lead screw 42 may be formed on the inner circumference of the screw hole 51E. Accordingly, when the elevating motor 40 rotates the lead screw 42, the steamer 30 and the rotation motor 50 may elevate together.

However, the present disclosure is not limited thereto, and of course, a configuration in which a rack gear formed long in the vertical direction on the inner surface of the cabinet 10 is provided and a pinion gear meshed with the rack gear is connected to the elevating motor 40 is also possible. In this case, the elevating motor 40 may be elevated together with the steamer 30.

At least one of both side portions of the steamer 30 may be connected to the rotation motor 50. For example, both side portions of the steamer 30 may be connected to the rotation motor 50, respectively.

However, hereinafter, as illustrated in FIG. 1, a case where the rotary motor 50 is connected to one of both side portions of the steamer 30 and the connector 53 is connected to the other steamer will be described as an example. In more detail, the rotation motor 50 may be connected to either one of both side portions of the steamer 30 to rotate the steamer 30, and the other one of both side portions of the steamer 30 can be rotatably connected to the connector 53.

The rotation motor 50 and the connector 53 may be located on a straight line in the left and right direction. Accordingly, the steamer 30 may rotate about a virtual rotation axis (not illustrated) that is formed long in the left and right direction.

Accordingly, the steamer 30 can be rotated by the rotation motor 50 to contact the clothing C, and in this state, the steamer 30 can spray steam while elevating to effectively spread wrinkles or folds of the clothing C. In addition, the steamer may spray steam on the clothing C at various angles.

A guide bar 41 for guiding the elevation of the steamer 30 may be provided inside the cabinet 10. The guide bar 41 may be disposed long in the vertical direction.

It is preferable that a pair of guide bars 41 are provided. The pair of guide bars 41 may include a first guide bar 41A located on one side (for example, the right side) of the steamer 30, and a second guide bar 41B located on the other side (for example, the left side) of the steamer 30.

The first guide bar 41A and the second guide bar 41B may be provided on inner surfaces of the cabinet 10 in the left and right direction, respectively.

The first guide bar 41A may guide one side portion of the steamer 30 in the vertical direction, and the second guide bar 41B may guide the other side portion of the steamer 30 in the vertical direction. In more detail, the first guide bar 41A may guide the rotation motor bracket 51 on which the rotation motor 50 is mounted in the vertical direction, and the second guide bar 41B may guide the connector 53 in the vertical direction.

Accordingly, the steamer 30, the rotation motor 50, the rotation motor bracket 51, and the connector 53 may be guided in elevation by the guide bar 41. This will be described in detail later.

Meanwhile, in a case where the clothing C (see FIG. 14A) are hung on the clothing supporter 20 held on the holder 60, since the arms C2 and C3 of the clothing C droop downward, an overlapping portion is inevitably formed between the body C1 and the arms C2 and C3, and wrinkles occur. In this state, in a case where the steamer 30 elevates and sprays steam to refresh the clothing C, there is a risk that the wrinkles cannot be removed and wrinkles may become worse.

In order to solve this risk, the clothing processing apparatus according to the present embodiment may include a separator 90 that separates the body C1 and arms C2 and C3 of the clothing C, and a separator moving motor 100 that moves the separator 90 in the left and right direction.

The separator 90 may move in the left and right direction and move between the body C1 and the arms C2 and C3 of the clothing C to separate the body C1 and the arms C2 and C3.

A pair of separators 90 may be provided. In other words, the pair of separators 90 may include a first separator 90A and a second separator 90B.

The first separator 90A separates the body C1 of the clothing C and one arm C2, and the second separator 90B may separate the body C1 of the clothing C and the other arm C3.

The first separator 90A and the second separator 90B can each independently move in the left and right direction.

The separator 90 may include a moving bar 91 that is formed long in the vertical direction, and a separate part 92 that is formed long in the front and rear direction at the upper end of the moving bar 91. The separator 90 may further include a moving body 93 to which a lower end of the moving bar 91 is connected and which is moved by the separator moving motor 100.

The moving bar 91 may be formed long in the vertical direction. The moving bar 91 may be formed by a combination of a straight part and a curved part. Accordingly, the moving bar 91 can move in the left and right direction while avoiding interference with other components disposed in the inner space of the cabinet 10—for example, the blower 130.

The moving bar 91 may pass through the inside of the steamer 30 forming a single closed curve. Accordingly, the separator 90 can move in the left and right direction without interfering with the steamer 30.

A separate part 92 may be formed at the upper end of the moving bar 91. The separate part 92 may be formed long from the upper end of the moving bar 91 in the front and rear direction. The separate part 92 may include extension parts 92A formed at both ends.

The lower end of the moving bar 91 is connected to the moving body 93 to move together with the moving body 93. The moving body 93 may move along the separator guide rail 103 in the left and right direction by the separator moving motor 100.

The separator guide rail 103 may be provided on an inner bottom surface of the cabinet 10. The separator guide rails 103 may be disposed long in the left and right direction.

The separator moving motor 100 may be provided on an inner bottom surface of the cabinet 10. A pair of separator moving motors 100 may be provided. One of the pair of separator moving motors 100 may move the first separator 90A, and the other may move the second separator 90B.

A configuration in which the separator moving motor 100 moves the separator 90 will be described in detail later.

Meanwhile, the clothing processing apparatus according to the present embodiment may include a spreader 110 for applying a mechanical force to the clothing C (see FIG. 17A), and a spreader moving motor 120 for moving the spreader 110 in the left and right direction. The clothing processing apparatus according to the present embodiment may further include a blower 130 that assists the operation of the spreader 110.

The spreader 110 may move in the left and right direction and move into the body C1 of the clothing C to apply a mechanical force so that the body C1 is tautly tensioned.

A pair of spreaders 110 may be provided. In other words, the pair of spreaders 110 may include a first spreader 110A and a second spreader 1108.

The first spreader 110A can press the body C1 from the inner portion of one side of the body C1 of the clothing C to the outside, and the second spreader 1108 can press the body C1 from the inner portion of the other side of the body C1 of the clothing C to the outside. In other words, the pressing directions of the first spreader 110A and the second spreader 1108 may be opposite to each other, and thus the body C1 of the clothing C may be tautly tensioned.

The first spreader 110A and the second spreader 1108 may each independently move in the left and right direction.

The first spreader 110A and the second spreader 1106 may be located opposite to each other with respect to the blower 130. In other words, the first spreader 110A may move from one side of the blower 130 in the left and right direction, and the second spreader 1106 may move from the other side of the blower 130 in the left and right direction. This is because the movement range of the spreader 110 in the left and right direction does not need to be as large as that of the separator 90. With the above configuration, the clothing processing apparatus may be compact.

The spreader 110 is formed long in the vertical direction and may include the tension part 111 that moves into the body C1 of the clothing C, and a moving body 112 to which the tension part 111 are connected and that moves in the left and right direction by the spreader moving motor 120.

The tension part 111 may be formed long in the vertical direction. The length of the tension part 111 may be variable. In more detail, the tension part 111 may have a multi-stage structure with a variable length. This may have a structure similar to that of a conventional antenna with a variable length.

The tension part 111 may have a predetermined elasticity with respect to the horizontal direction. Accordingly, the tension part 111 can be bent according to the inner shape of the body C1 of the clothing C and can reliably tension the body C1.

The tension part 111 may be maintained at a minimum length in normal times. In this case, the tension part 111 may have a length that does not interfere with the rotating steamer 30.

When a mechanical force is applied to the clothing C, the tension part 111 may extend long upwardly as illustrated in FIGS. 1 and 2. In this case, the tension part 111 may extend to a length inserted into the body C1 of the clothing C.

The extended tension part 111 may pass through the inner portion of the steamer 30 forming a single closed curve. Accordingly, the spreader 110 can move in the left and right direction without interfering with the steamer 30.

The tension part 111 may be connected to the moving body 112 and move together with the moving body 112. The moving body 112 may move in the left and right direction along the spreader guide rail 123 by the spreader moving motor 120.

The spreader guide rail 123 may be provided on an inner bottom surface of the cabinet 10. The spreader guide rail 123 may be disposed long in the left and right direction.

The spreader guide rail 123 may be spaced apart from the separator guide rail 103 in the front and rear direction. The spreader guide rail 123 may be disposed in parallel with the separator guide rail 103.

The spreader moving motor 120 may be provided on an inner bottom surface of the cabinet 10. A pair of spreader moving motors 120 may be provided. One of the pair of spreader moving motors 120 may move the first spreader 110A, and the other may move the second spreader 1108.

A configuration in which the spreader moving motor 120 moves the spreader 110 will be described in detail later.

Meanwhile, the blower 130 may be disposed in the inner portion of the cabinet 10 and blow air into the body C1 of the clothing C from the lower side of the clothing C.

The blower 130 may be provided on an inner bottom surface of the cabinet 10. The blower 130 may generate an upward-facing air flow so that the body C1 of the clothing C is opened. As a result, the spreader 110 extends upward and can easily move into the body C1 of the clothing C.

In more detail, the blower 130 may include a blowing fan 131, an air guide 132 for guiding the air blown by the blowing fan 131, and a blowing fan supporting part 133 for supporting the blowing fan 131.

The blowing fan 131 may be disposed toward the upper side and may blow air upward.

The air guide 132 may be located above the blowing fan 131. The air guide 132 may minimize the spread of the air blown by the blowing fan 131 and guide the air to flow into the body C1 of the clothing C.

In more detail, the air guide 132 may include a plate part coupled to the upper side of the blowing fan 131, and a guide part protruding upward from the plate part and having a hollow shape.

The blowing fan supporting part 133 may support the blowing fan from the lower side. The blowing fan supporting part 133 may have a box shape with both side surfaces and an opened bottom surface. The spreader guide rail may be disposed through the inner portion of the blowing fan supporting part 133. Thereby, the clothing processing apparatus can be made compact.

Figure 3:
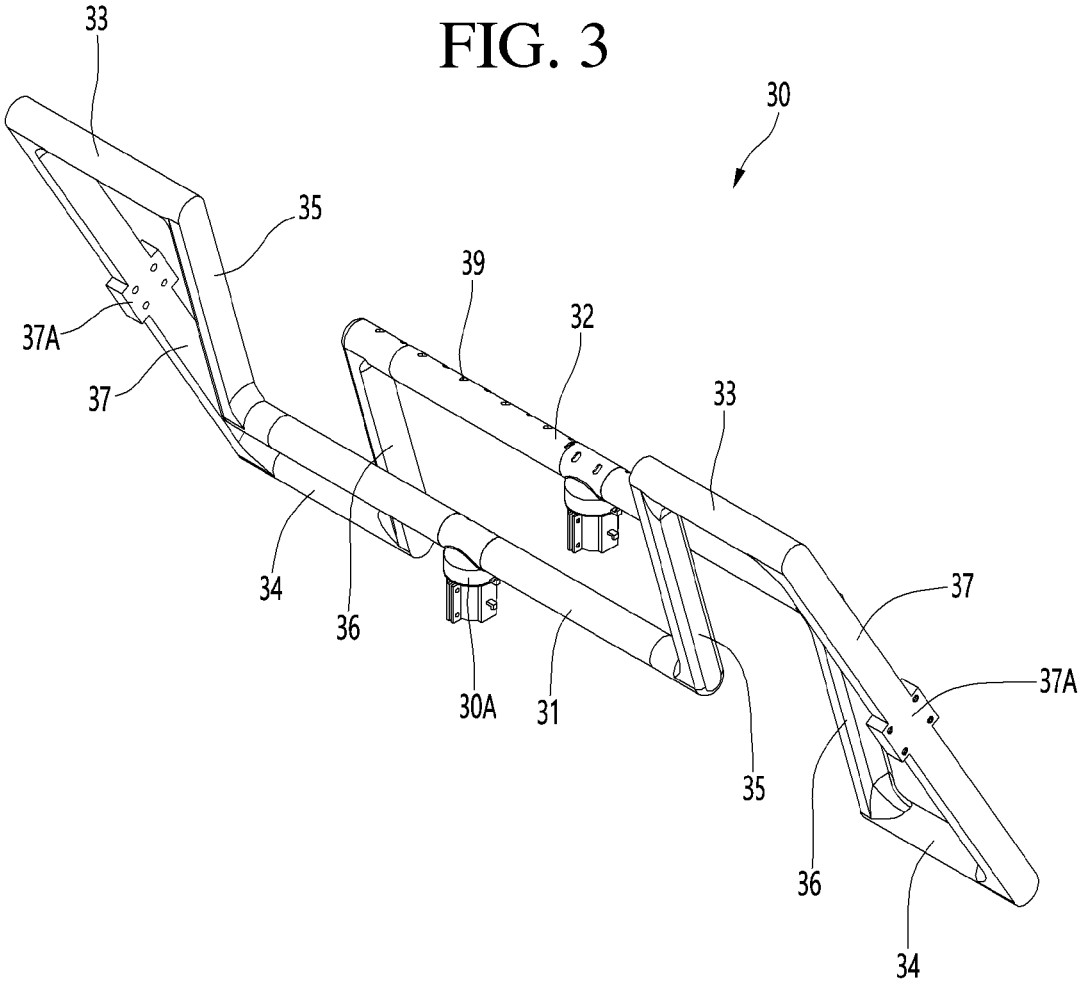
FIG. 3 is a perspective view illustrating a steamer according to an embodiment of the present disclosure.
Figure 4:
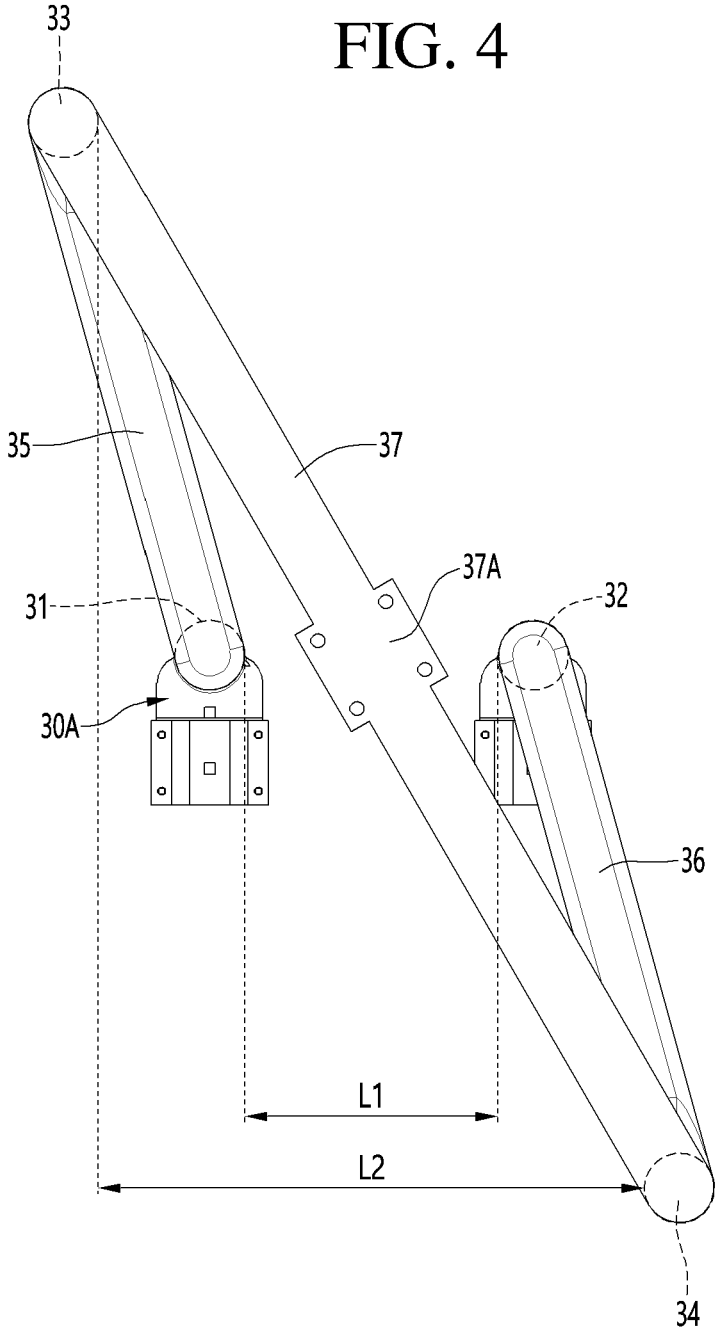
FIG. 4 is a side view illustrating a steamer according to an embodiment of the present disclosure.
Figure 5A:
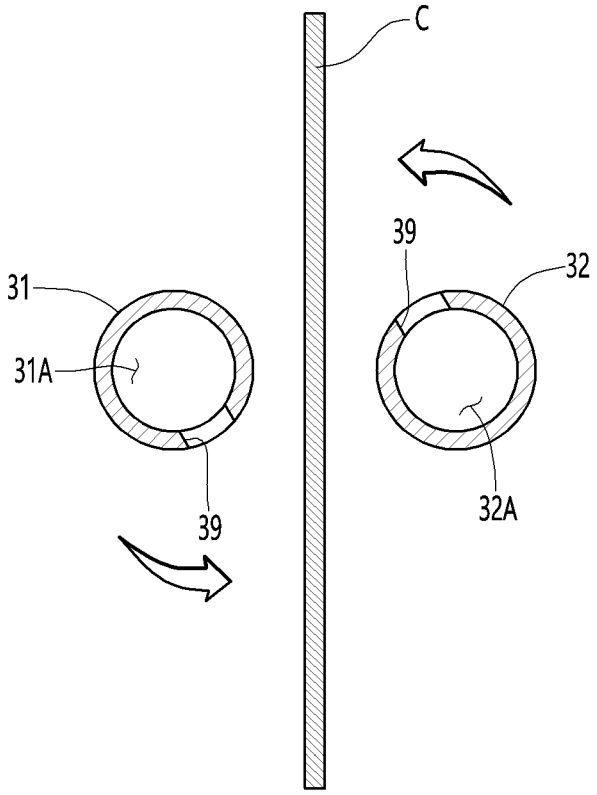
FIGS. 5A and 5B are views for explaining the operation of a steamer according to an embodiment of the present disclosure.
Figure 5B:
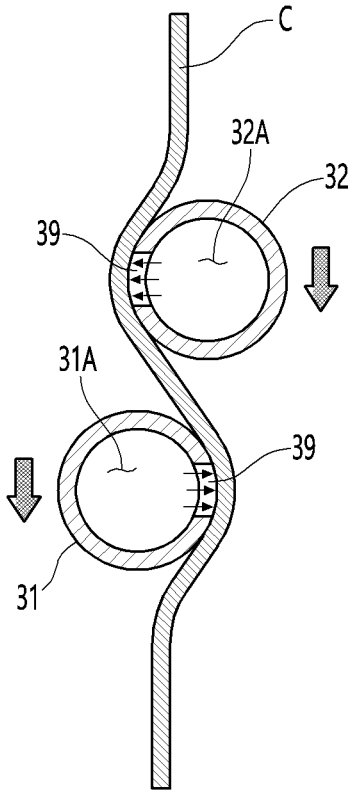

FIG. 3 is a perspective view illustrating a steamer according to an embodiment of the present disclosure, FIG. 4 is a side view illustrating a steamer according to an embodiment of the present disclosure, and FIGS. 5A and 5B are views for explaining the operation of a steamer according to an embodiment of the present disclosure.

The steamer 30 may form a single closed curve.

In more detail, the steamer 30 may include a front steam body 31, a rear steam body 32, a front auxiliary body 33, a rear auxiliary body 34, a front connection part 35, a rear connection part 36, and an outer connection part 37.

The front steam body 31 and the rear steam body 32 may have a bar shape formed long in the left and right direction. The front steam body 31 and the rear steam body 32 may be disposed side by side.

The rear steam body 32 may be spaced apart from the rear of the front steam body 31.

The clothing C hung on the clothing supporter 20 may move between the front steam body 31 and the rear steam body 32.

The front steam body 31 may spray steam toward the front surface of the clothing C hung on the clothing supporter 20, and the rear steam body 32 may spray steam toward the back surface of the clothing C hung on the clothing supporter 20.

The front steam body 31 and the rear steam body 32 may be provided with a plurality of steam spraying parts 39. The steam spraying part 39 may be configured as a hole or a nozzle.

The plurality of steam spraying parts 39 formed on the front steam body 31 may be spaced apart from each other by a predetermined distance in the longitudinal direction of the front steam body 31. The plurality of steam spraying parts 39 formed in the rear steam body 32 may be spaced apart from each other by a predetermined distance in the longitudinal direction of the rear steam body 32.

In addition, the steam injector 30A described above may be provided on the front steam body 31 and the rear steam body 32.

The steam injector 30A is preferably fastened to the central portion of the front steam body 31 and the rear steam body 32. Accordingly, compared to the case where the steam injector 30A is fastened to an eccentric position on one side of the front steam body 31 and the rear steam body 32, steam can be smoothly guided to each steam injector 39.

An inner steam flow path 31A and 32A for guiding the steam injected to the steam injector 30A to each steam spraying part 39 may be formed in the front steam body 31 and the rear steam body 32. Accordingly, steam may be sprayed from the steam spraying part 39 toward the clothing C.

The front auxiliary body 33 and the rear auxiliary body 34 may have a bar shape which is formed long in the left and right direction. The front auxiliary body 33 and the rear auxiliary body 34 may be disposed side by side.

The front auxiliary body 33 and the rear auxiliary body 34 may be spaced apart from each other.

The front auxiliary body 33 may be located more forward than the front steam body 31, and the rear auxiliary body 34 may be located more rearward than the rear steam body 32.

The outer end portion of the front auxiliary body 33 may be located more outside than the end portion of the front steam body 31. The outer end portion of the rear auxiliary body 34 may be located more outside than the end portion of the rear steam body 32.

A pair of the front auxiliary body 33 and a pair of the rear auxiliary body 34 may be provided.

One front auxiliary body 33 may be connected to one end portion of the front steam body 31 by the front connection part 35. The other front auxiliary body 33 may be connected to the other end of the front steam body 31 by the front connection part 35.

One rear auxiliary body 34 may be connected to one end of the rear steam body 32 by a rear connection part 36. The other rear auxiliary body 34 may be connected to the other end portion of the rear steam body 32 by the rear connection part 36.

In a case where one arm C2 of the clothing C (see FIGS. 15A and 15B) is separated from the body C1 by the separator 90 and droops downward, the one arm C2 can pass through between the front steam body 31 and the rear steam body 32, and the body C1 and the other arm C3 may pass through between one front auxiliary body 33 and one rear auxiliary body 34.

In a case where the other arm C3 of the clothing C (see FIGS. 16A and 16B) is separated from the body C1 by the separator 90 and droops downward, the other arm C3 may pass through between the front steam body 31 and the rear steam body 32, and the body C1 and one arm C2 are may pass through between the other front auxiliary body 33 and the other rear auxiliary body 34.

The distance L2 between the front auxiliary body 33 and the rear auxiliary body 34 in the front and rear direction may be greater than the distance L1 between the front steam body 31 and the rear steam body 32 in the front and rear direction. Accordingly, there is an advantage that any one of the body C1 and the arms C2 and C3 of the clothing C can smoothly move between the front auxiliary body 33 and the rear auxiliary body 34 by the separator 90, and the wrinkle of the clothing C can be minimized.

The front connection part 35 may connect the front steam body 31 and the front auxiliary body 33 to each other. The rear connection part 36 may connect the rear steam body 32 and the rear auxiliary body 34.

The front connection part 35 may be formed long in a forward inclined direction from the end portion of the front steam body 31. The rear connection part 36 may be formed long in a rearward inclined direction from the end portion of the rear steam body 32.

The rear connection part 36 may be parallel to the front connection part 35.

As illustrated in FIG. 4, the front connection part 35 may be formed to be inclined in a direction in which the height increases from the end portion of the front steam body 31 toward the front, and the rear connection part 36 may be formed to be inclined in a direction in which the height decreases from the end portion of the rear steam body 32 toward the rear.

However, the present disclosure is not limited thereto, and the front connection part 35 may be formed to be inclined in a direction in which the height decreases from the end portion of the front steam body 31 toward the front, and the rear connection part 36 may be formed to be inclined in a direction in which the height increases from the end portion of the rear steam body 32 toward the rear.

The outer connection part 37 may connect the front auxiliary body 33 and the rear auxiliary body 34 to each other. In more detail, the outer connection part 37 may connect the outer end portion of the front auxiliary body 33 and the outer end portion of the rear auxiliary body 34.

The outer connection part 37 may be formed to be inclined in the front and rear direction. The outer connection part 37 may be formed long in a direction forming an acute angle with the front connection part 35 and the rear connection part 36.

The front connection part 35 and the rear connection part 36 may be formed to be steeper than the outer connection part 37. In other words, the angle formed by the front connection part 35 and the rear connection part 36 in the horizontal direction may be greater than the angle formed by the outer connection part 37 in the horizontal direction.

At least one of the pair of outer connection parts 37 may be connected to the rotation motor 50. For example, the rotation motor 50 (see FIG. 1) may be connected to any one of the pair of outer connection parts 37, and the connector 53 may be connected to the other outer connection part. In other words, one of both end portions of the steamer 30 may be connected to the rotation motor 50, and the other outer connection part may be rotatably connected to the connector 53. However, the present disclosure is not limited thereto, and of course, a configuration in which both end portions of the steamer 30 are respectively connected to the rotation motor 50 is also possible.

In more detail, a fastening part 37A may be formed in the outer connection part 37. The fastening part 37A may include at least one fastening hole. The fastening part 37A is preferably formed in the middle part of the outer connection part 37.

A first coupler 55 (see FIG. 7) connected to the rotary motor 50 may be fastened to the fastening part 37A of the outer connection part 37. Accordingly, the first coupler 55 may connect the rotation motor 50 and the steamer 30.

A second coupler 56 (see FIG. 8) rotatably connected to the connector 53 may be fastened to the fastening part 37A of the other outer connection part 37. Accordingly, the second coupler 56 may connect the connector 53 and the steamer 30.

Meanwhile, the steamer 30 may apply a mechanical force to the clothing C and simultaneously spray steam to iron the clothing C. In more detail, the front steam body 31 and the rear steam body 32 may spray steam while applying a mechanical force to the clothing C.

As illustrated in FIG. 5A, the clothing C may pass between the front steam body 31 and the rear steam body 32 and droop downward. In this state, the steamer 30 may rotate so that the front steam body 31 is in contact with the front surface of the clothing C and the rear steam body 32 is in contact with the back surface of the clothing C.

As illustrated in FIG. 5B, the steamer 30 may rotate until at least a portion of each of the front steam body 31 and the rear steam body 32 overlaps in the vertical direction.

According to the degree of rotation of the steamer 30, the steam spraying part 39 of the front steam body 31 and the rear steam body 32 may spray steam to the clothing C at various angles.

The steamer 30 may lower in a state where the front steam body 31 and the rear steam body 32 are overlapped in the vertical direction and may spray steam from the steam spraying part 39. Accordingly, the upper portion of the clothing C can be taut by applying mechanical force downward by the steamer 30 in a state of being supported by the clothing supporter 20, and wrinkles or folds of the clothing C can be effectively removed.

Figure 6:
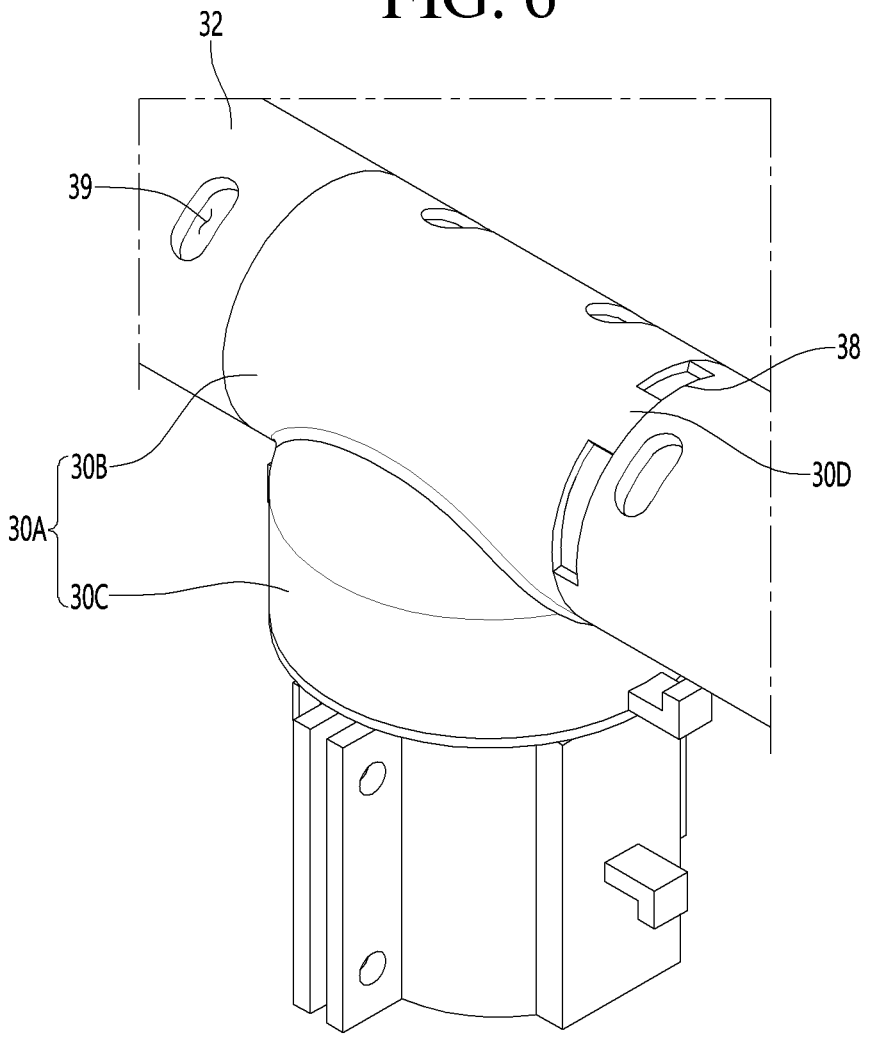
FIG. 6 is a view illustrating a steam injector fastened to the steamer according to an embodiment of the present disclosure.

FIG. 6 is a view illustrating a steam injector fastened to the steamer according to an embodiment of the present disclosure.

As described above, the steam injector 30A may be connected to the front steam body 31 and the rear steam body 32. Hereinafter, the steam injector 39 connected to the rear steam body 32 will be described as an example, whereby those skilled in the art will be able to easily understand the steam injector 30A coupled to the front steam body 31 as well.

The rear steam body 32 may include a first rear steam body connected to one side of the steam injector 30A and a second rear steam body connected to the other side of the steam injector 30A.

The steam injector 30A may include a connection part 30B connected to the rear steam body 32 and an injector 30C connected to the outer circumference of the connection part 30B.

The first rear steam body may be connected to one side of the connection part 30B, and the second rear steam body may be connected to the other side thereof. The first rear steam body, the connection part 30B, and the second rear steam body may form a bar shape formed long in the left and right direction. In other words, the connection part 30B may be formed long in a direction parallel to the rear steam body 32.

The inner portion of the connection part 30B may communicate with the inner steam flow path 32A (see FIG. 5A or FIG. 5B) of the rear steam body 32.

The inside of the injector 30C may communicate with the inner portion of the connection part 30B. The injector 30C may be connected to a steam generator (not illustrated) by a steam hose (not illustrated). Accordingly, the steam injected from the steam generator to the injector 30C may pass through the connection part 30B to be divided into the first rear steam body and the second rear steam body to flow and can be sprayed from the steam injector 39.

The injector 30C may be connected to the outer circumference of the connection part 30B. The injector 30C may be formed to protrude radially outward of the connection part 30B.

Meanwhile, the steam injector 30A may be rotatably connected to the rear steam body 32 within a predetermined range.

In more detail, a stopper groove 38 having a predetermined length in the circumferential direction may be formed in the rear steam body 32, and a stopper protrusion 30D moving within the stopper groove 38 may be formed in the steam injector 30A.

The stopper groove 38 may be formed at an end portion of the side of at least one steam injector 30A of the first rear steam body and the second rear steam body. The stopper protrusion 30D may protrude toward the stopper groove 38 from the end portion of the connection part 30B of the steam injector 30A.

In a case where the steamer 30 rotates within a predetermined range, the steam injector 30A may face downward by its own load and the load of the steam hose connected to the steam injector 30A. On the other hand, when the steamer 30 rotates beyond the predetermined range, the stopper protrusion 30D may be caught on one end portion of both end portions of the stopper groove 38, and the steam injector 30A may rotate together with the steamer 30.

Accordingly, it is possible to prevent the steam injector 30A or the steam hose connected thereto from interfering with the clothing C.

Figure 7:
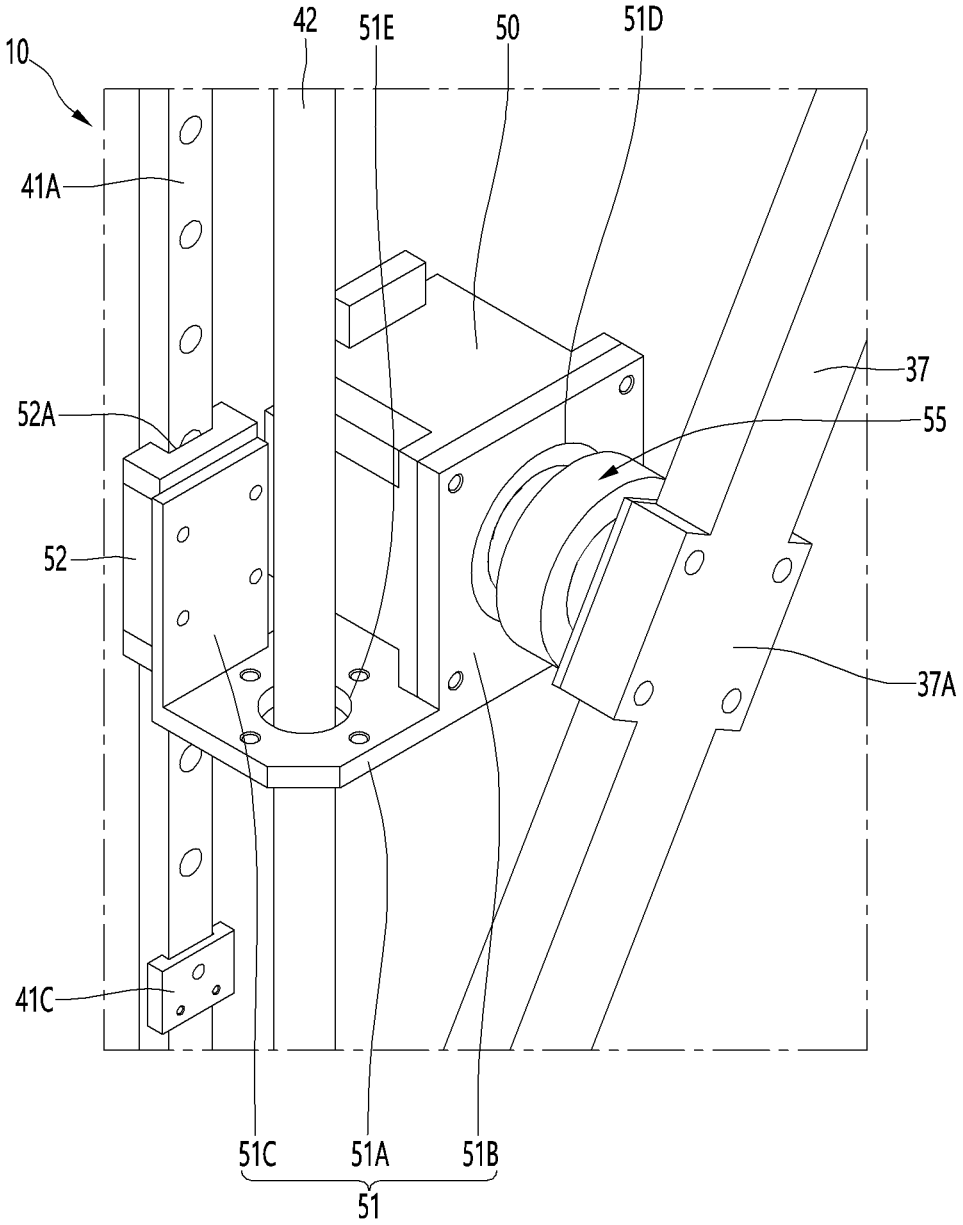
FIG. 7 is an enlarged view illustrating a rotation motor and surroundings thereof according to an embodiment of the present disclosure.

FIG. 7 is an enlarged view illustrating a rotation motor and surroundings thereof according to an embodiment of the present disclosure.

The rotation motor 50 may be mounted on the rotation motor bracket 51, and a guide block 52, which is elevated and guided along the first guide bar 41A, may be fastened to the rotation motor bracket 51.

In more detail, the rotation motor bracket 51 may include a plate part 51A, a motor fastening part 51B, and a block fastening part 51C. The plate part 51A, the motor fastening part 51B, and the block fastening part 51C may be integrally formed but is not limited thereto.

The plate portion 51A may be horizontally disposed.

The plate part 51A may be located above or below the rotation motor 50. For example, the plate portion 51A may support the rotation motor 50 from the lower side.

A screw hole 51E through which the lead screw 42 passes may be formed on the rotation motor bracket 51. The lead screw 42 passing through the screw hole 51E may pass through the front or rear of the rotary motor 50.

In more detail, the screw hole 51E may be formed by vertically penetrating the plate portion 51A. A female thread corresponding to the outer circumference of the lead screw 42 may be formed on the inner circumference of the screw hole 51E. Accordingly, the rotation motor bracket 52 can be elevated according to the rotation of the lead screw 42.

A rotation motor 50 may be fastened to the motor coupling part 51B. For example, the motor coupling part 51B may have a plate shape that is vertically bent upward from the plate part 51A to face the steamer 30.

A coupler through-hole 51D through which the first coupler 55 connecting the rotation motor 50 and the steamer 30 passes may be formed on the rotation motor bracket 51. In more detail, the coupler through-hole 51D may be formed to pass through the motor fastening part 51B in the left and right direction.

The first coupler 55 may be fastened to the outer connection part 37 of the steamer 30, more specifically, the fastening portion 37A. The first coupler 55 and the steamer 30 may be rotated together by the rotation motor 50.

The guide block 52 may be fastened to the block fastening part 51C. For example, the block fastening part 51C may have a plate shape that is vertically bent upwardly from the plate part 51A to face the guide block 52. The block coupling part 51C may be spaced apart from the motor coupling part 51B.

A guide groove 52A formed long in the vertical direction may be formed in the guide block 52 fastened to the block fastening portion 51C, and the first guide bar 41A may be fitted into the guide groove 52A. Accordingly, the guide block 52 may be guided in elevation by the first guide bar 41A.

Meanwhile, the guide bar 41 may be provided with at least one limiter 41C for limiting the lifting or lowering range of the steamer 30.

In more detail, when the elevation of the steamer 30 deviates from the preset range, the guide block 52 is caught by the limiter 41C and can no longer be lifted. Accordingly, the elevating range of the steamer 30 can be easily limited.

Figure 8:
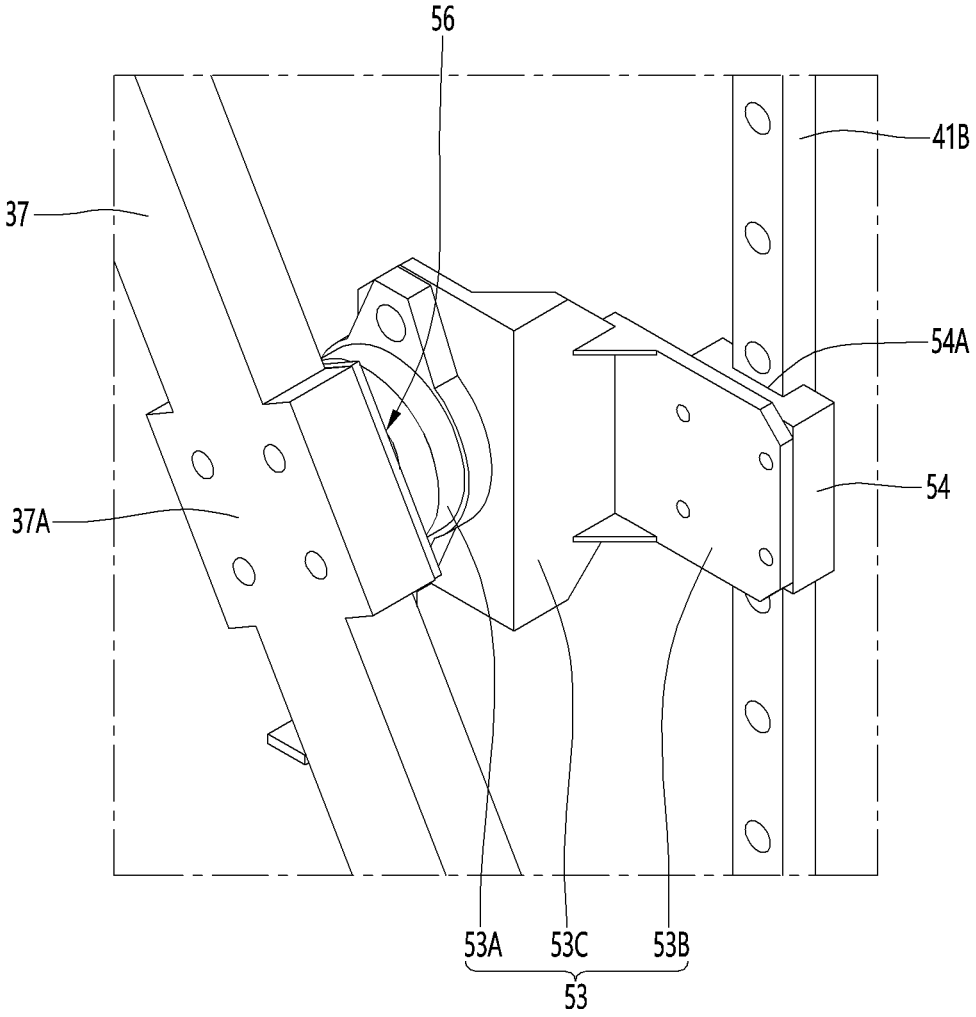
FIG. 8 is an enlarged view illustrating a connector and surroundings thereof according to an embodiment of the present disclosure.
Figure 9:
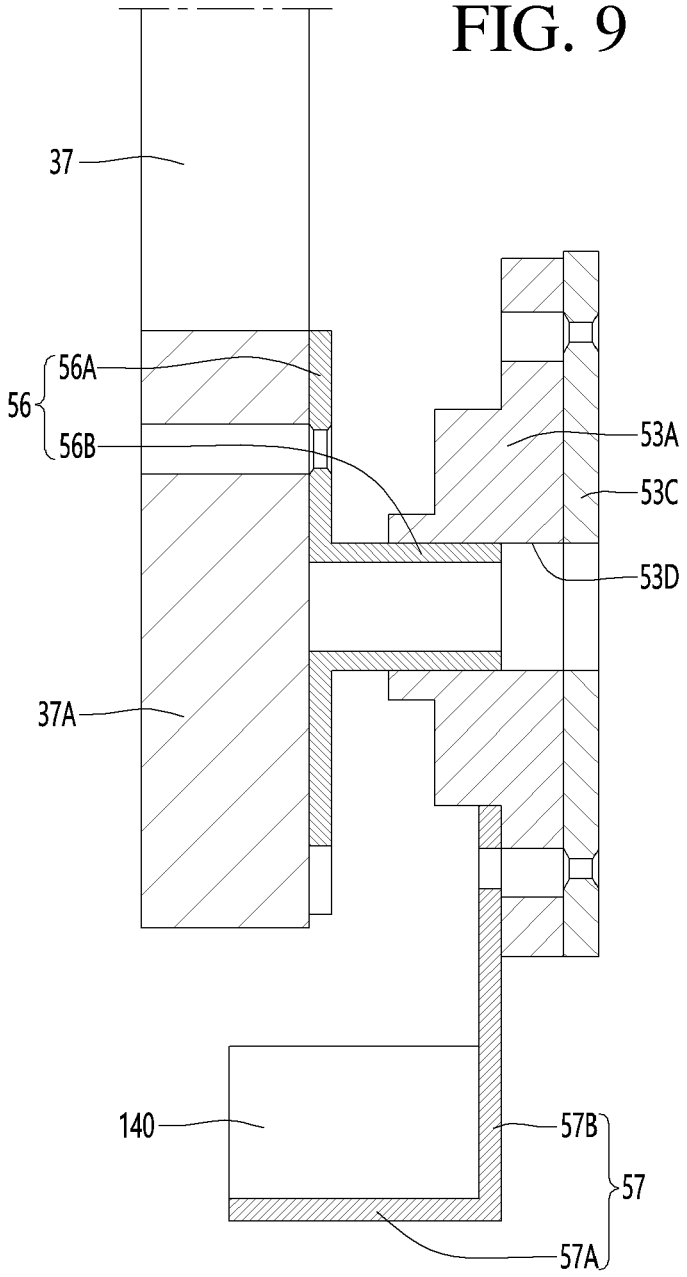
FIG. 9 is a cross-sectional view for explaining a state where a steamer and a connector are connected according to an embodiment of the present disclosure.
Figure 10:
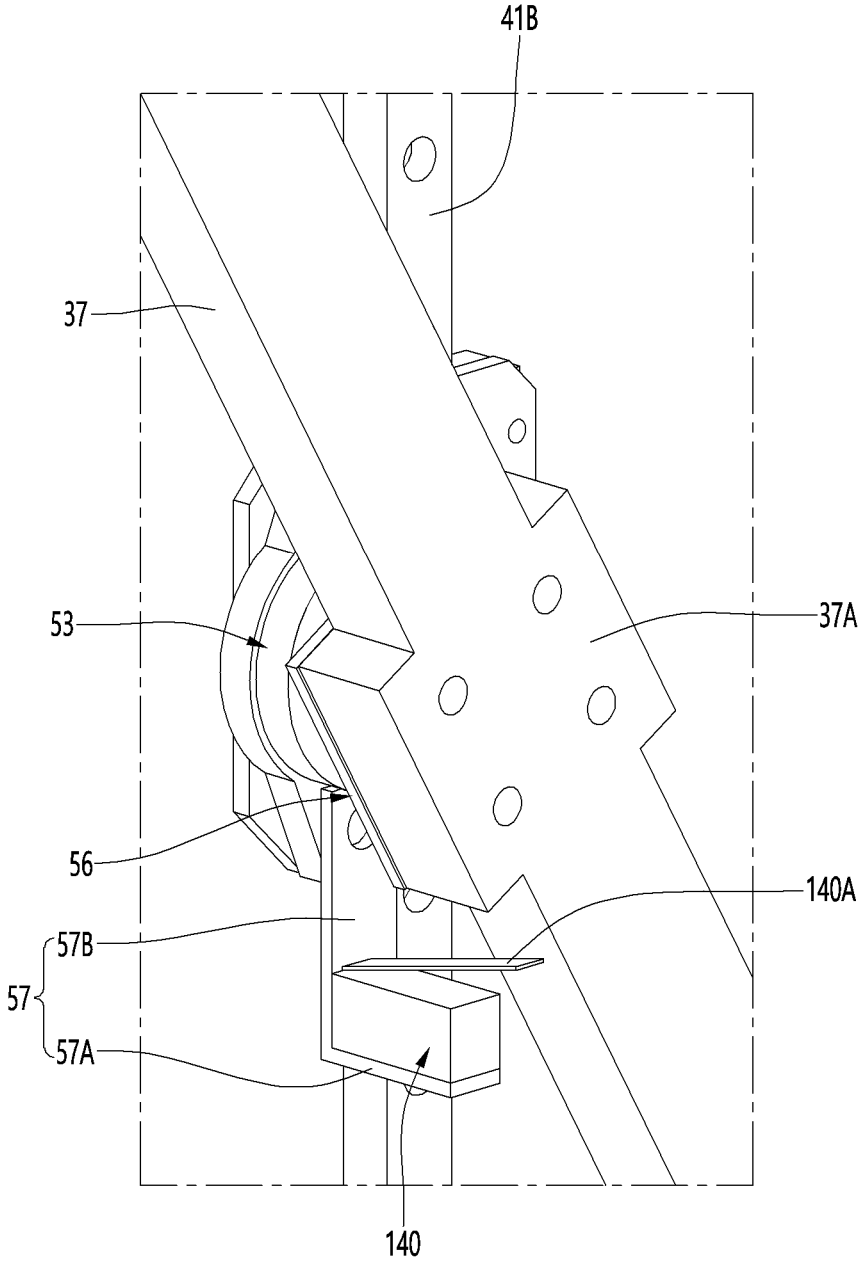
FIG. 10 is a view illustrating a limit switch according to an embodiment of the present disclosure.

FIG. 8 is an enlarged view illustrating a connector and surroundings thereof according to an embodiment of the present disclosure, FIG. 9 is a cross-sectional view for explaining a state where a steamer and a connector are connected according to an embodiment of the present disclosure, and FIG. 10 is a view illustrating a limit switch according to an embodiment of the present disclosure.

The steamer 30 may be rotatably connected to the connector 53 by the second coupler 56. The second coupler 56 may include the outer connection part 37 of the steamer 30, more specifically, a fastening plate 56A fastened to a fastening part 37A, and a rotation shaft 56B protruding from the fastening plate 56A toward the connector 53.

The rotation shaft 56B may have a circular bar shape. An insertion hole 53D into which the rotation shaft 56B is inserted may be formed on the connector 53.

In addition, a guide block 54 that is elevated and guided along the second guide bar 41B may be fastened to the connector 53.

In more detail, the connector 53 may include a coupler insertion part 53A, a block fastening part 53B, and a connection part 53C.

The block fastening part 53B and the connection part 53C may be integrally formed, and the coupler insertion part 53A may be fastened to the connection part 53C. However, the present disclosure is not limited thereto.

The coupler insertion part 53A may face the steamer 30. The coupler insertion part 53A may be formed vertically. The coupler insertion part 53A may be formed with an insertion hole 53D formed long in the left and right direction. The rotation shaft 56B of the second coupler 56 may be inserted into the insertion hole 53D. Accordingly, the steamer 30 may be rotatably connected to the connector 53.

The guide block 54 may be fastened to the block fastening part 53B. The block fastening part 53B may have a vertical plate shape facing the guide block 54. The block coupling part 53B may be spaced apart from the coupler insertion part 53A.

A guide groove 54A formed long in the vertical direction may be formed in the guide block 54 fastened to the block fastening part 53B, and the second guide bar 41B may be fitted into the guide groove 54A. Accordingly, the guide block 54 may be guided in elevation by the second guide bar 41B.

The connection part 53C may connect the coupler insertion part 53A and the block fastening part 53B.

The connection part 53C may be formed by bending at least once. For example, the connection part 53C may include a first plate coupled to the coupler insertion part 53A, and a second plate bent vertically from the first plate and connected to the block coupling part 53B.

Meanwhile, the clothing processing apparatus according to the embodiment of the present disclosure may further include a limit switch 140 pressed by the steamer 30.

The steamer 30 may be configured to rotate so that the outer connection part 37 presses the ground protrusion 140A of the limit switch 140.

The limit switch 140 may be mounted on the connector 53. In other words, the connector 53 may further include a switch mounting part 57 on which the limit switch 140 is mounted.

In more detail, the switch mounting part 57 may include a switch support part 57A for supporting the limit switch 140 from the lower side, and a connection part 57B for connecting the switch support part 57A to the coupler insertion portion 53A.

The switch support part 57A may be formed horizontally, and the connection part 57B may be formed vertically. The connection part 57B may be bent upwardly from the end portion of the switch support part 57A.

Figure 11:
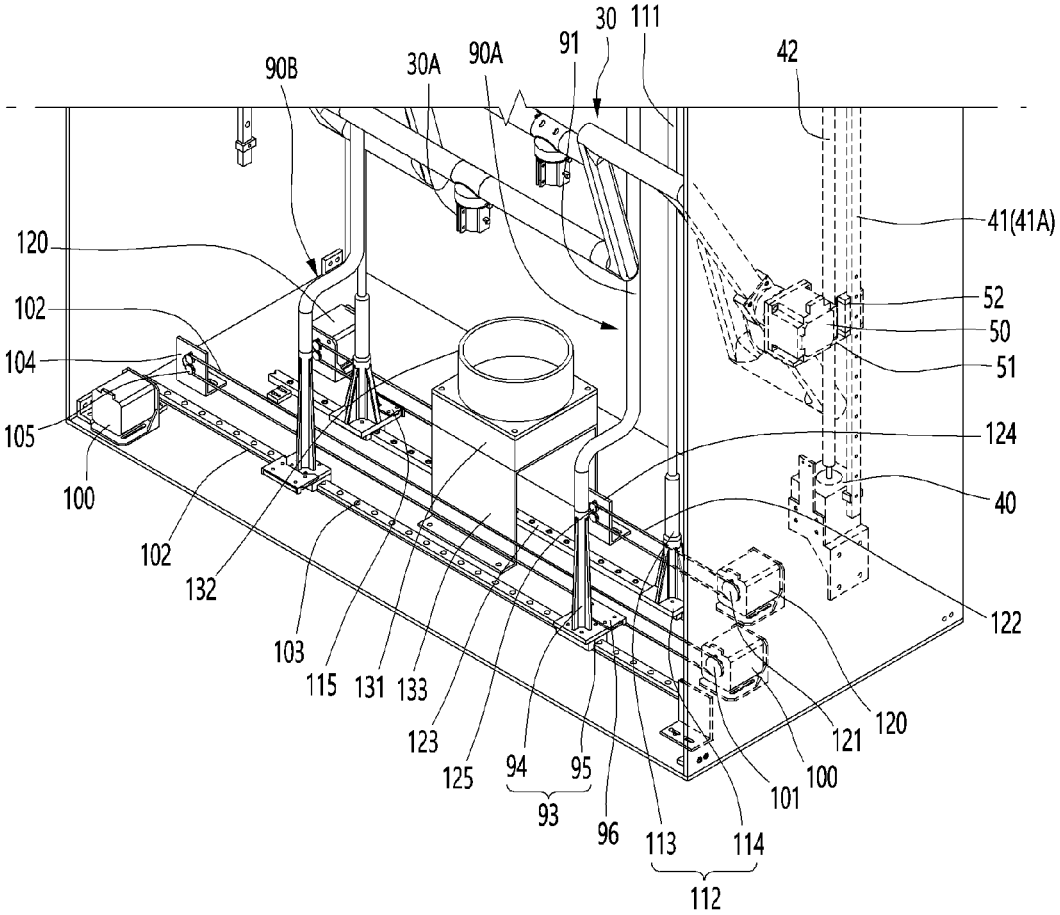
FIG. 11 is an enlarged view illustrating a lower portion of the clothing processing apparatus according to an embodiment of the present disclosure.

FIG. 11 is an enlarged view illustrating a lower portion of the clothing processing apparatus according to an embodiment of the present disclosure.

The moving body 93 of the separator 90 may include a main body 94 to which the moving bar 91 is fastened, and a guide block 95 moving along the separator guide rail 103.

The main body 94 may have a tubular shape formed long in the vertical direction. The lower end of the moving bar 91 may be inserted into the main body 94 to be fitted thereinto. A plurality of ribs for reinforcing rigidity may be formed on the outer circumference of the main body 94. The plurality of ribs may be connected to the guide block 95.

A main body 94 may be coupled to the guide block 95. The guide block 95 may be integrally formed with the main body 94 but is not limited thereto.

A guide groove into which the separator guide rail 103 is fitted may be formed on the bottom surface of the guide block 95. Accordingly, the guide block 95 may be guided to move along the separator guide rail 103 in the left and right direction.

The moving body 93 of the separator 90 may be provided with a belt holder 96 to which the power of the separator moving motor 100 is transmitted. The belt holder 96 may hold the belt 102 rotating by the separator moving motor 100.

The belt holder 96 may be fastened to the guide block 95 at the front or rear of the guide block 95. The belt holder 96 can be moved by the power of the belt 102 rotating by the separator moving motor 100. Thereby, the entire separator 90 can move smoothly in the left and right direction.

The separator moving motor 100 may be provided on an inner bottom surface of the cabinet 10. A pair of separator moving motors 100 may be provided. One of the pair of separator moving motors 100 may move the first separator 90A, and the other may move the second separator 90B.

The pair of separator moving motors 100 may be located opposite to each other with respect to the separator guide rail 103. Accordingly, the belt 102 connected to each separator moving motor 100 can rotate smoothly without interfering with each other.

For example, the separator moving motor 100 for moving the first separator 90A is located behind the separator guide rail 103, and the separator moving motor 100 for moving the second separator 90B can be located in front of the separator guide rail 103.

In this case, the belt holder 96 of the first separator 90A is fastened from the rear of the guide block 95 of the first separator 90A, and the belt holder 96 of the second separator 90B may be fastened in front of the guide block 95 of the second separator 90B.

The power of the separator moving motor 100 may be transmitted to the separator 90 through the belt 102. In more detail, one side of the belt 102 forming a closed curve is in contact with the rotary pulley 101 connected to the separator moving motor 100, and the other side of the belt may be in contact with the support pulley 105 installed in the separator pulley bracket 104. When the rotary pulley 101 rotates, the belt 102 may rotate by the frictional force between the rotary pulley 101 and the belt 102. In this case, the support pulley 105 may support the belt 102 while rotating by frictional force with the belt 102.

The belt holder 96 of the separator 90 may be connected to the belt 102. Accordingly, the separator 90 can move in the left and right direction according to the rotation of the belt 102.

However, the present disclosure is not limited thereto, and of course, a configuration in which a rotation gear is connected to the separator rotation motor 100, a chain is connected to the rotation gear, and a belt holder 96 of the separator 90 is connected to the chain is also possible.

The separator guide rail 103 may be provided on an inner bottom surface of the cabinet 10. The separator guide rails 103 may be disposed long in the left and right direction. The separator guide rail 103 may be fitted into the guide groove formed in the guide block 95 of the separator 90 to guide the movement of the separator 90 in the left and right direction.

The separator pulley bracket 104 may be provided on an inner bottom surface of the cabinet 10. A pair of separator pulley brackets 104 may be also provided similarly to the separator moving motor 100. The pair of separator pulley brackets 104 may be located opposite to each other with respect to the separator guide rail 103.

The separator pulley bracket 104 connected to one of the separator moving motors 100 and the belt 102 may face the other separator moving motor 100 in the front and rear direction. Accordingly, the movement range of the separator 90 in the left and right direction can be secured to the maximum for the limited length of the belt 102.

Meanwhile, the moving body 112 of the spreader 110 may include a main body 113 to which the tension part 111 is connected, and a guide block 114 located below the main body 94 and moving along the spreader guide rail 123.

The main body 113 may have a tubular shape formed long in the vertical direction. The lower end of the tension part 111 may be inserted into the main body 113 to be fitted thereinto. A plurality of ribs for reinforcing rigidity may be formed on the outer circumference of the main body 113. The plurality of ribs may be connected to the guide block 114.

A main body 113 may be coupled to the guide block 114. The guide block 114 may be formed integrally with the main body 113 but is not limited thereto.

A guide groove into which the spreader guide rail 123 is fitted may be formed on the bottom surface of the guide block 114. Accordingly, the guide block 114 may be guided to move along the spreader guide rail 123 in the left and right direction.

The moving body 112 of the spreader 110 may be provided with a belt holder 115 to which the power of the spreader moving motor 120 is transmitted. The belt holder 115 may hold the belt 122 rotating by the spreader moving motor 120.

The belt holder 115 may be fastened to the guide block 114 at the front or rear of the guide block 114. The belt holder 115 may be moved by the power of the belt 122 rotating by the spreader moving motor 120. Accordingly, the spreader 110 as a whole can move smoothly in the left and right direction.

The spreader moving motor 120 may be provided on an inner bottom surface of the cabinet 10. A pair of spreader moving motors 120 may be provided. One of the pair of spreader moving motors 120 may move the first spreader 110A, and the other may move the second spreader 1108.

The pair of spreader moving motors 120 may be located opposite to each other with respect to the blower 130.

The power of the spreader moving motor 120 may be transmitted to the spreader 110 through the belt 122. In more detail, one side of the belt 122 forming a closed curve may be in contact with the rotary pulley 121 connected to the spreader moving motor 120, and the other side may be in contact with the support pulley 125 installed in the spreader pulley bracket 124. When the rotary pulley 121 rotates, the belt 122 may rotate by the frictional force between the rotary pulley 121 and the belt 122. In this case, the support pulley 125 may support the belt 122 while rotating by frictional force with the belt 122.

The belt holder 115 of the spreader 110 may be connected to the belt 122. Accordingly, the spreader 110 may move in the left and right direction according to the rotation of the belt 122.

However, the present disclosure is not limited thereto, and of course, a configuration in which a rotation gear is connected to the spreader rotation motor 120, a chain is connected to the rotation gear, and a belt holder 115 of the spreader 110 is connected to the chain is also possible.

The spreader guide rail 123 may be provided on an inner bottom surface of the cabinet 10. The spreader guide rail 123 may be disposed long in the left and right direction. The spreader guide rail 123 may be fitted into the guide groove formed in the guide block 114 of the spreader 110 to guide the movement of the spreader 110 in the left and right direction.

The spreader guide rail 123 may be spaced apart from the separator guide rail 103 in the front and rear direction. The spreader guide rail 123 may be disposed in parallel with the separator guide rail 103.

The length of the spreader guide rail 123 may be shorter than the length of the separator guide rail 103. The spreader guide rail 123 may pass through the inner portion of the blowing fan supporting part 133, and the separator guide rail 103 may pass through the outer front or outer rear of the blowing fan supporting part 133.

The spreader pulley bracket 124 may be provided on the inner bottom surface of the cabinet 10. A pair of spreader pulley brackets 124 may be provided similarly to the spreader moving motor 120.

The length of the belt 122 connecting the spreader moving motor 120 and the spreader pulley bracket 124 in the left and right direction may be shorter than the length of the belt 102 connecting the separator moving motor 100 and the separator pulley bracket 124 in the left and right direction. In more detail, the length of the belt 122 connecting the spreader moving motor 120 and the spreader pulley bracket 124 in the left and right direction may be less than half of the length of the belt 102 connecting the separator moving motor 100 and the separator pulley bracket 124 in the left and right direction.

Figure 12:
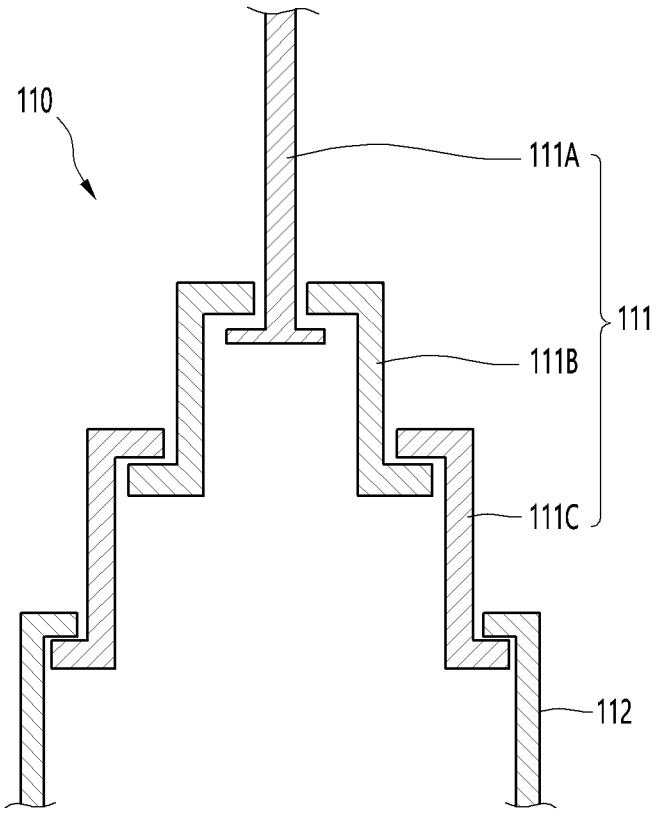
FIG. 12 is a view for explaining a tension part of a spreader according to the embodiment of the present disclosure.

FIG. 12 is a view for explaining a tension part of a spreader according to the embodiment of the present disclosure.

As described above, the tension part 111 of the spreader 110 may have a multi-stage structure in which the length is variable.

In more detail, the tension part 111 may include an insertion part 111A, at least a part of which is inserted into the body C1 of the clothing C (see FIG. 17A), and at least one hollow part 111B and 111C which connects the insertion part 111A and the moving body 112 to each other. Hereinafter, a case where the first hollow part 111B and the second hollow part 111C are included in the tension part 111 will be described as an example.

The insertion portion 111A, the first hollow portion 111B, and the second hollow portion 111C may be formed long in the vertical direction.

The insertion part 111A may be received in the first hollow part 111B, the first hollow part 111B may be received in the second hollow part 111C, and the second hollow part 111C may be received in the main body 113 of the moving body 112.

The outer diameter of the insertion part 111A is smaller than the inner diameter of the first hollow part 111B, the outer diameter of the first hollow part 111B is smaller than the inner diameter of the second hollow part 111C, and the outer diameter of the second hollow part 111C may be smaller than the inner diameter of the main body 113 of the moving body 112.

The inner portion of the first hollow portion 111B, the second hollow portion 111C, and the main body 113 may communicate with each other.

A first hanging part hung on the upper end of the first hollow portion 111B may be formed on the lower end of the insertion portion 111A. A second hanging part hung on the upper end of the second hollow part 111C may be formed on the lower end of the first hollow part 111B. A third hanging part hung on the upper end of the main body 113 of the moving body 112 may be formed on the lower end of the second hollow part 111C.

With the configuration of the tension part 111, the length of the tension part 111 in the vertical direction can be easily variable. Accordingly, the insertion portion 111A may extend upwardly from the moving body 112 to be inserted into the body C1 of the clothing C.

Figure 13A:
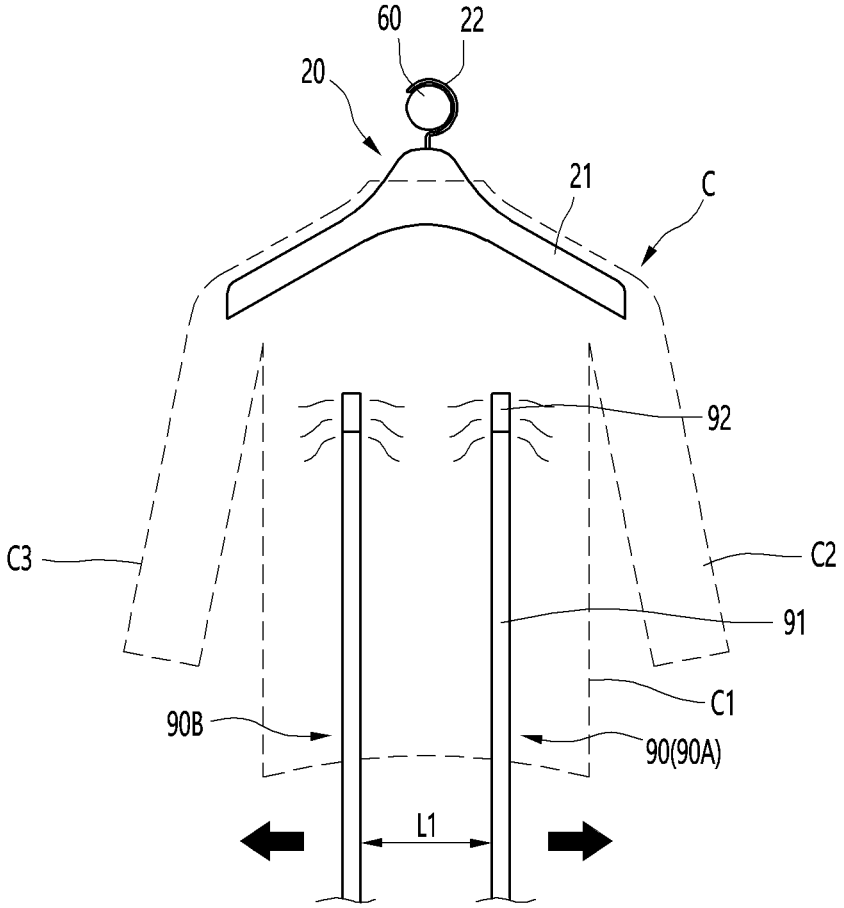
FIGS. 13A and 13B are views illustrating an initial position of a separator according to an embodiment of the present disclosure.
Figure 13B:
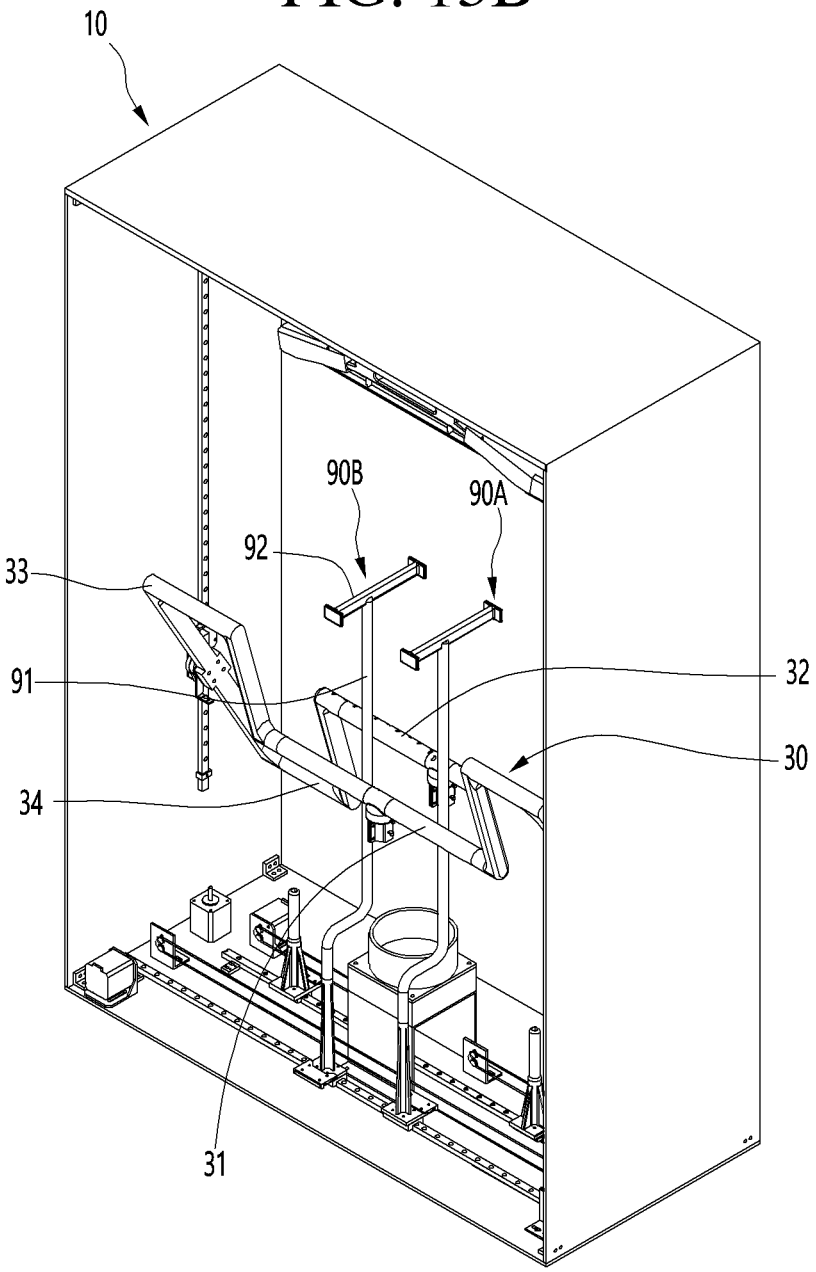

FIGS. 13A and 13B are views illustrating an initial position of a separator according to an embodiment of the present disclosure. In more detail, FIG. 13A is a view for explaining the positional relationship between the separator and the clothing hung on the clothing supporter, and FIG. 13B is a view for explaining the positional relationship between the separator and the steamer.

The distance L1 between the pair of separators 90 in the left and right direction, which are in the initial position state may be shorter than the width of the body C1 of the clothing C in the left and right direction. Accordingly, when the clothing supporter 20 is held on the holder 60, the body C1 of the clothing C hung on the clothing supporter 20 may be in a state of being in contact by the separate parts 92 of each of the pair of separators 90. In this case, the separator 90 may be located at the front or rear of the body C1 of the clothing C.

In this case, the pair of separators 90 may be located between the front steam body 31 and the rear steam body 32 of the steamer 30 (see FIG. 3).

Figure 14A:
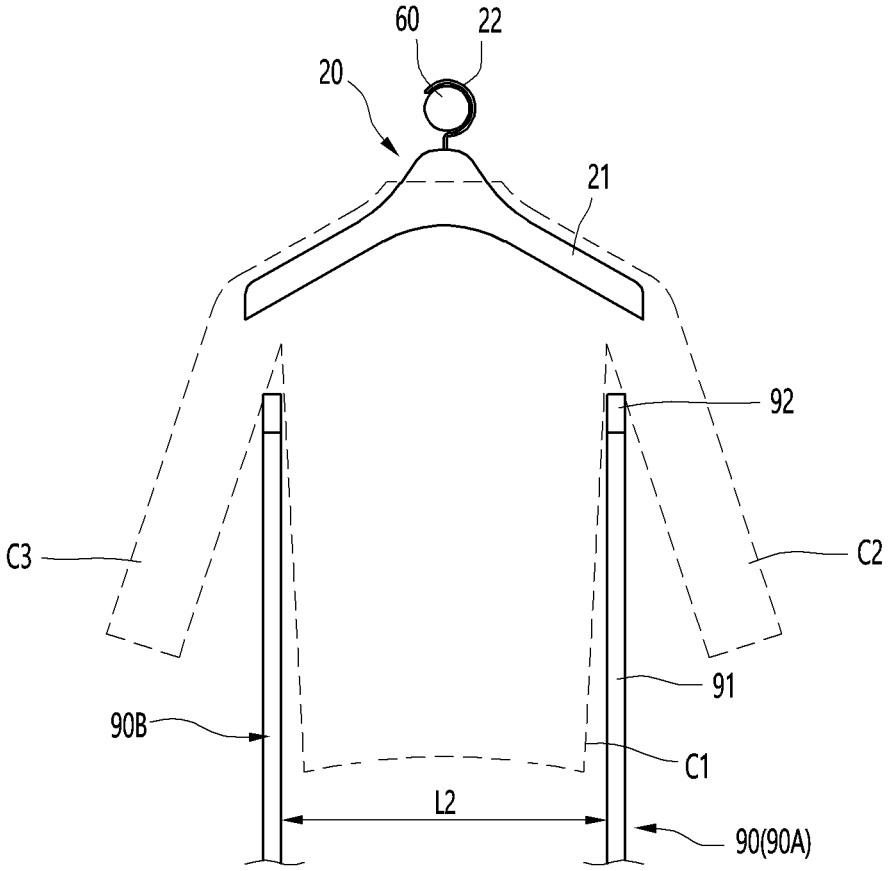
FIGS. 14A and 14B are views illustrating a state where a separator is moved between a body and an arm of clothing according to an embodiment of the present disclosure.
Figure 14B:
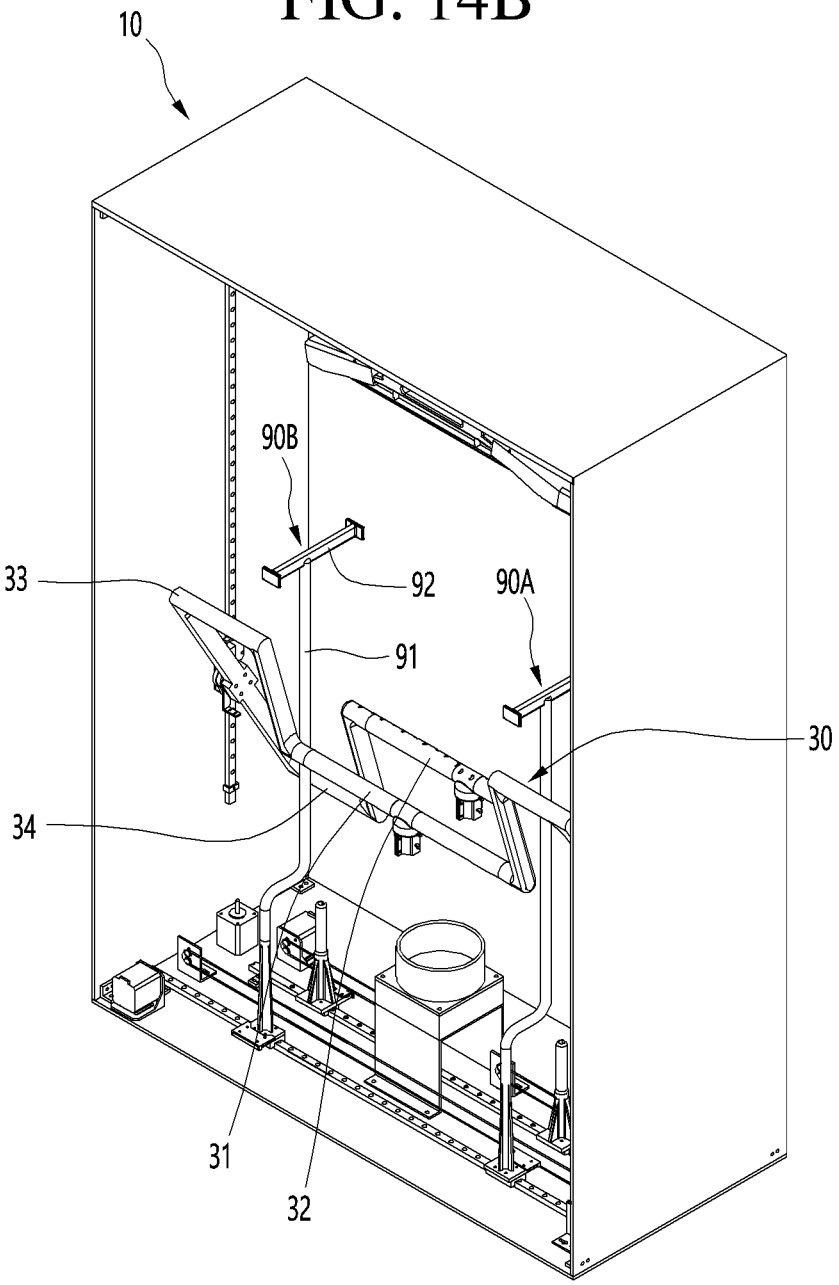

FIGS. 14A and 14B are views illustrating a state where a separator is moved between a body and an arm of clothing according to an embodiment of the present disclosure. In more detail, FIG. 14A is a view for explaining the positional relationship between the separator and the clothing hung on the clothing supporter, and FIG. 14B is a view for explaining the positional relationship between the separator and the steamer.

In a state where the separator 90 moves between the body and the arm of the clothing, the distance L2 between the pair of separators 90 in the left and right direction may be greater than the distance L1 between the pair of separators 90 in the left and right direction, which are in the initial position. In other words, the pair of separators 90 may move away from each other from the initial position and move between the body C1 and the arms C2 and C3 of the clothing C.

In more detail, the pair of separators 90 at their initial positions may move in a direction away from each other in a state of being in contact with the body C1 of the clothing C, and when the separate part 92 of the separator 90 reaches between the body C1 and the arms C2 and C3, the separate part 92 may naturally move between the body C1 and the arms C2 and C3 due to the sagging of the clothing C.

In more detail, the first separator 90A may be moved between the body C1 and one of the arms C2 of the clothing C, and the second separator 90B may be entered between the body C1 and the other of the arms C3 of the clothing C.

Since the separate part 92 of the separator 90 is formed long in the front and rear direction, the separate part 92 can reliably separate the body C1 and the arms C2 and C3 of the clothing C.

The pair of separators 90 may be configured to stop moving as soon as the pair of separators 90 move between the body C1 and the arms C2 and C3 of the clothing C. Alternatively, the pair of separators 90 may move further apart by a predetermined distance even after the pair of separators 90 move between the body C1 and the arms C2 and C3 of the clothing C.

Figure 15A:
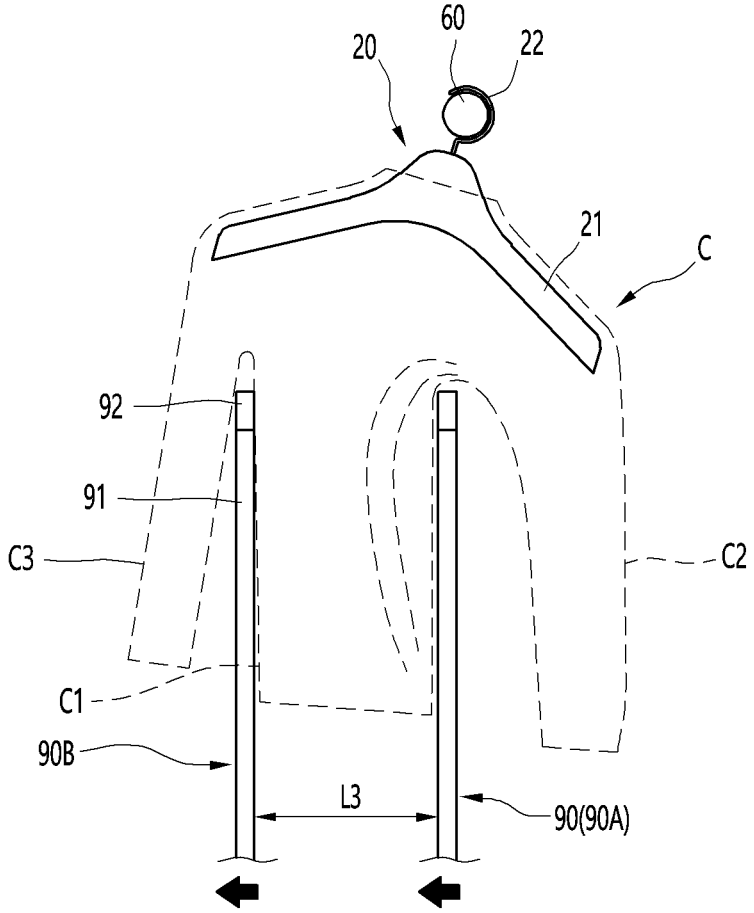
FIGS. 15A and 15B are views for explaining the operation of the separator for refreshing one arm of clothing.
Figure 15B:
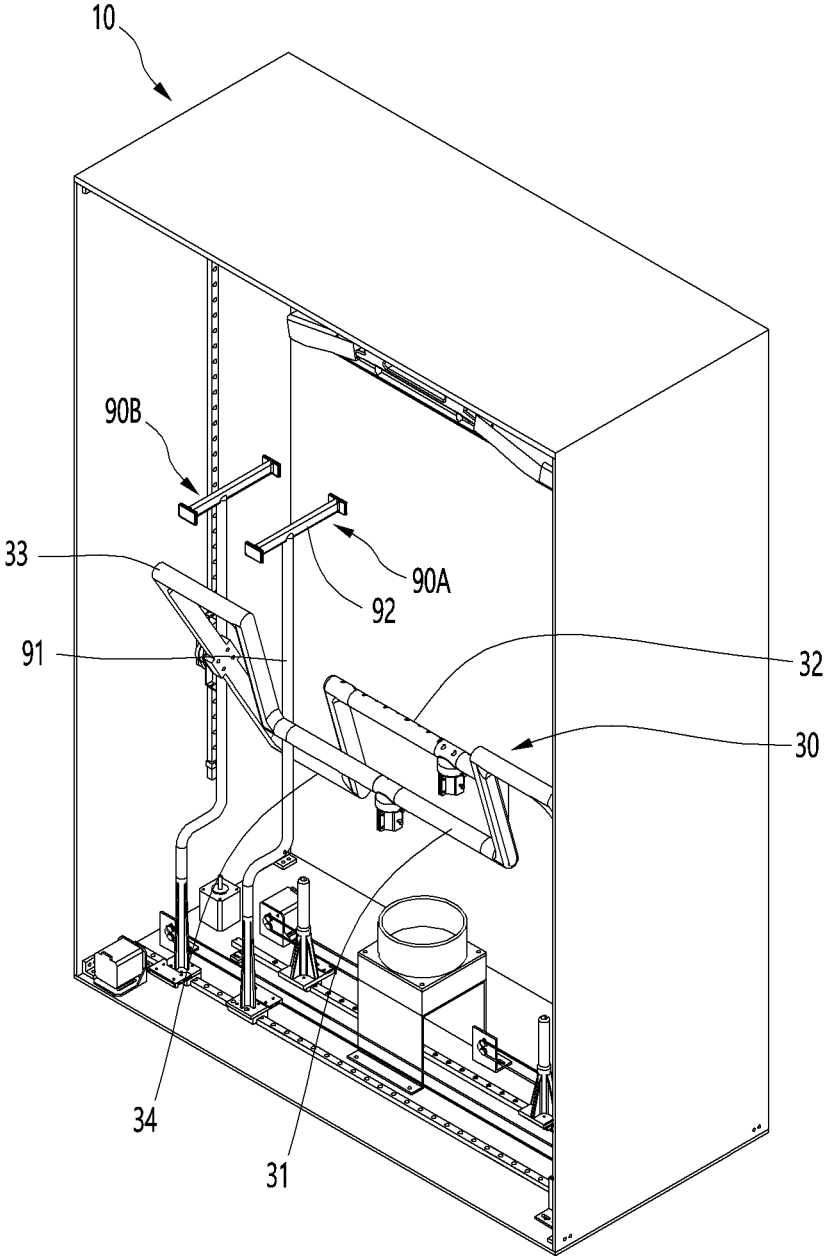

FIGS. 15A and 15B are views for explaining the operation of the separator for refreshing one arm of clothing. In more detail, FIG. 15A is a view for explaining the positional relationship between the separator and the clothing hung on the clothing supporter, and FIG. 15B is a view for explaining the positional relation between the separator and the steamer.

The separator 90 may move in one direction to separate one arm C2 of the clothing C from the body C1 and droop one arm downward.

In more detail, the first separator 90A and the second separator 90B may each move in one direction by a predetermined distance. In this case, the first separator 90A may move more than the second separator 90B. Accordingly, the distance L3 between the first separator 90A and the second separator 90B in the left and right direction in a state where one arm C2 of the clothing C is drooping downward may be closer than the distance L2 between the first separator 90A and the second separator 90B in the left and right direction immediately after moving between the arm C2 and C3 and the body C1 of the clothing C.

By the mechanical force applied to the clothing C by the separator 90, the ring 22 of the clothing supporter 20 slides with respect to the holder 60, and the clothing supporter 20 and the clothing C can be tilted. As a result, one arm C2 of the clothing C may be separated from the body C1 and droop downward.

In this case, the pair of separators 90 may be located between the front auxiliary body 33 and the rear auxiliary body 34 (see FIG. 3).

Accordingly, one arm C2 of the clothing C may be located between the front steam body 31 and the rear steam body 32 g1 (see FIG. 3), and the body C1 and the other arm C3 may be located between the front auxiliary body 33 and the rear auxiliary body 34.

Accordingly, in this state, when the steamer 30 elevates, the one arm C2 can be effectively refreshed without wrinkles by the steam sprayed from the front steam body 31 and the rear steam body 32. In addition, since the body C1 and the other arm C3 are located between the front auxiliary body 33 and the rear auxiliary body 34, it can be prevented the risk that the body C1 and the other arm C3 may not be refreshed in a wrinkled state and wrinkles thereof becomes severe.

Figure 16A:
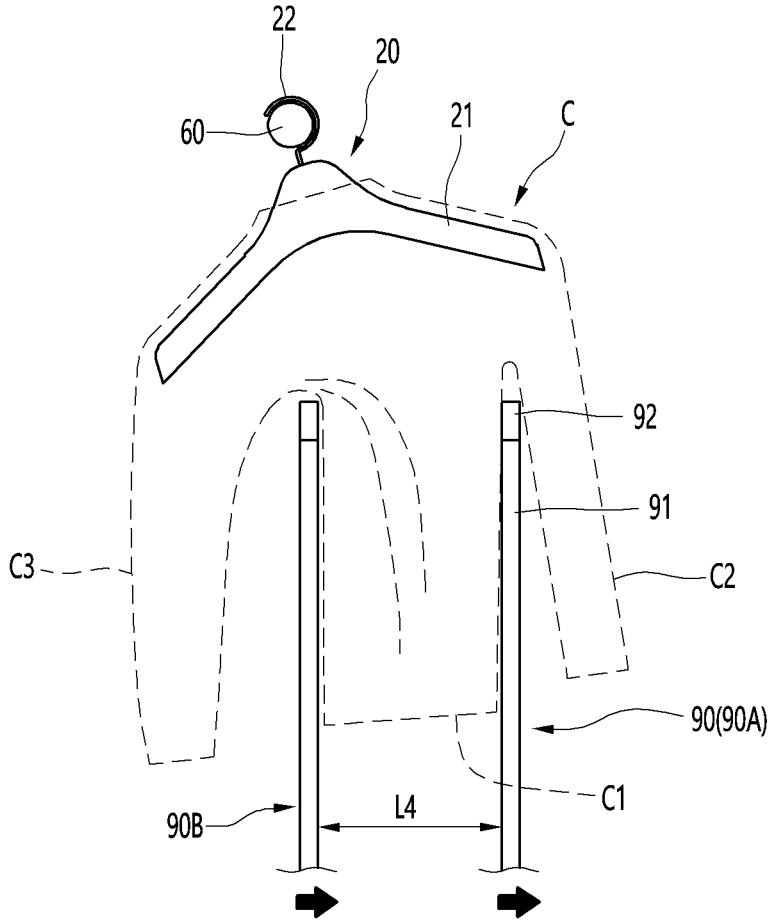
FIGS. 16A and 16B are views for explaining the operation of the separator for refreshing the other arm of the clothing.
Figure 16B:
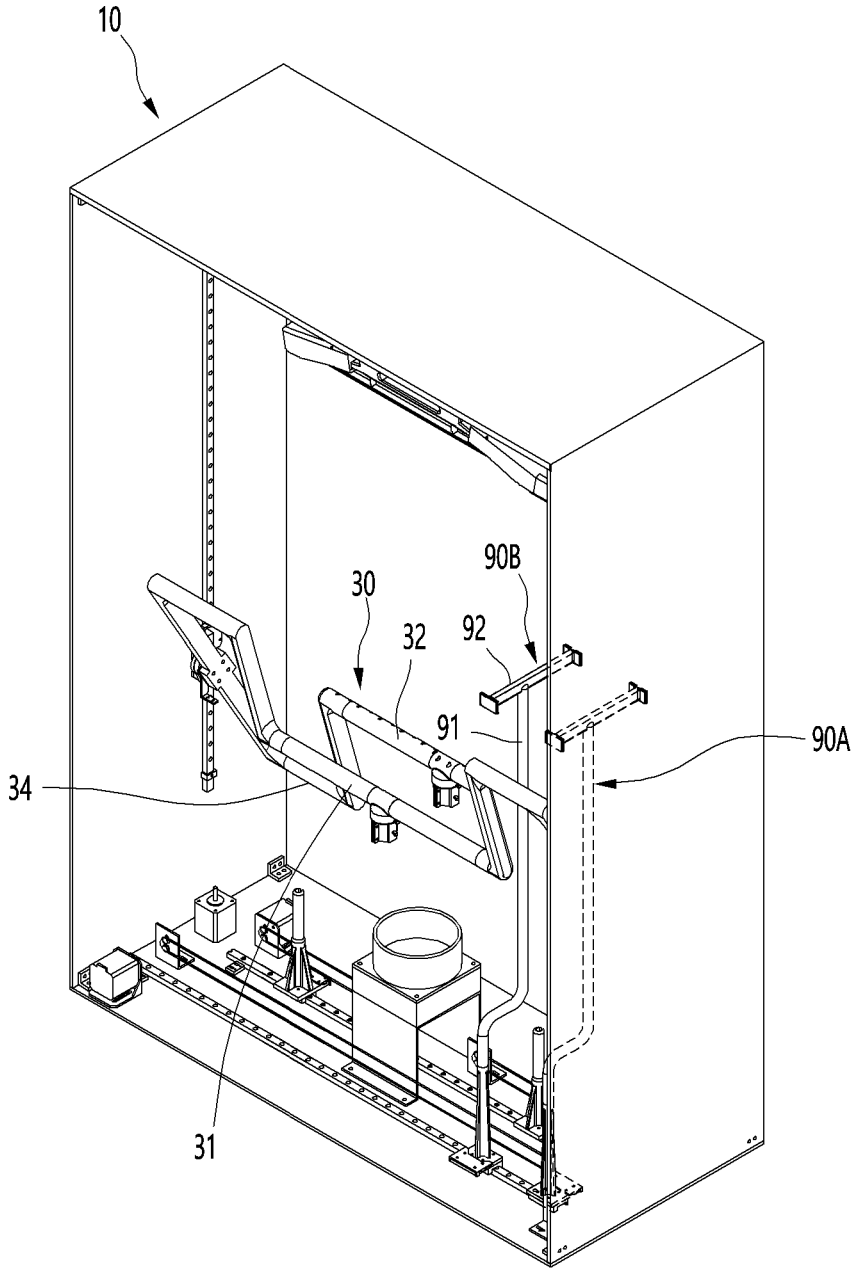

FIGS. 16A and 16B are views for explaining the operation of the separator for refreshing the other arm of the clothing. In more detail, FIG. 16A is a view for explaining the positional relationship between the separator and the clothing hung on the clothing supporter, and FIG. 16B is a view for explaining the positional relationship between the separator and the steamer.

The separator 90 may move in the other direction to separate the other arm C3 of the clothing C from the body C1 and droop it downward.

In more detail, the first separator 90A and the second separator 90B may each move in the other direction by a predetermined distance. In this case, the second separator 90B may move more than the first separator 90A. Accordingly, the distance L4 between the first separator 90A and the second separator 90B in the left and right direction in a state where the other arm C3 of the clothing C droops downward may be closer than the distance L2 between the first separator 90A and the second separator 90B in the left and right direction immediately after moving between the arm C2 and C3 and the body C1 of the clothing C.

By the mechanical force applied to the clothing C by the separator 90, the ring 22 of the clothing supporter 20 slides with respect to the holder 60, and the clothing supporter 20 and the clothing C can be tilted. Accordingly, the other arm C3 of the clothing C may be separated from the body C1 and may droop downward.

In this case, the pair of separators 90 may be located between the front auxiliary body 33 and the rear auxiliary body 34 (see FIG. 3).

Accordingly, the other arm C3 of the clothing C may be located between the front steam body 31 and the rear steam body 32 (see FIG. 3), and the body C1 and one arm C2 may be located between the front auxiliary body 33 and the rear auxiliary body 34.

Accordingly, in this state, when the steamer 30 elevates, the other arm C3 can be effectively refreshed without wrinkles by the steam sprayed from the front steam body 31 and the rear steam body 32. In addition, since the body C1 and the other arm C2 are located between the front auxiliary body 33 and the rear auxiliary body 34, it can be prevented the risk that the body C1 and the other arm C2 may not be refreshed in a wrinkled state and wrinkles thereof becomes severe.

Figure 17A:
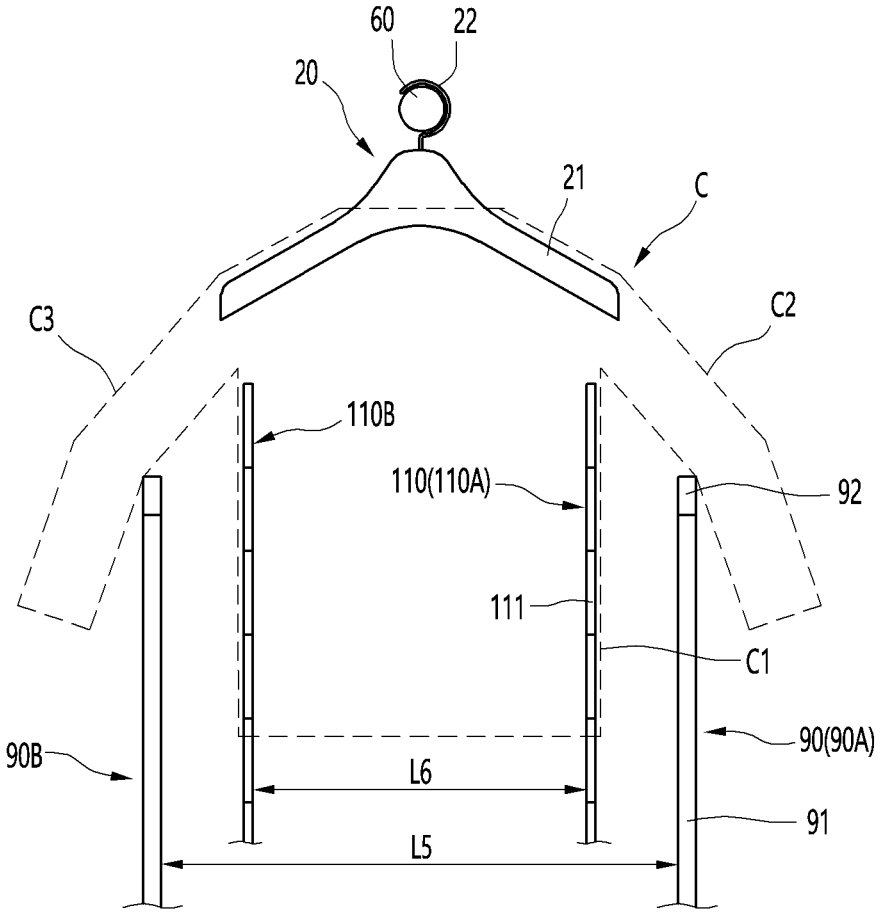
FIGS. 17A and 17B are views for explaining the operation of the separator and the spreader for refreshing the body of the clothing.
Figure 17B:
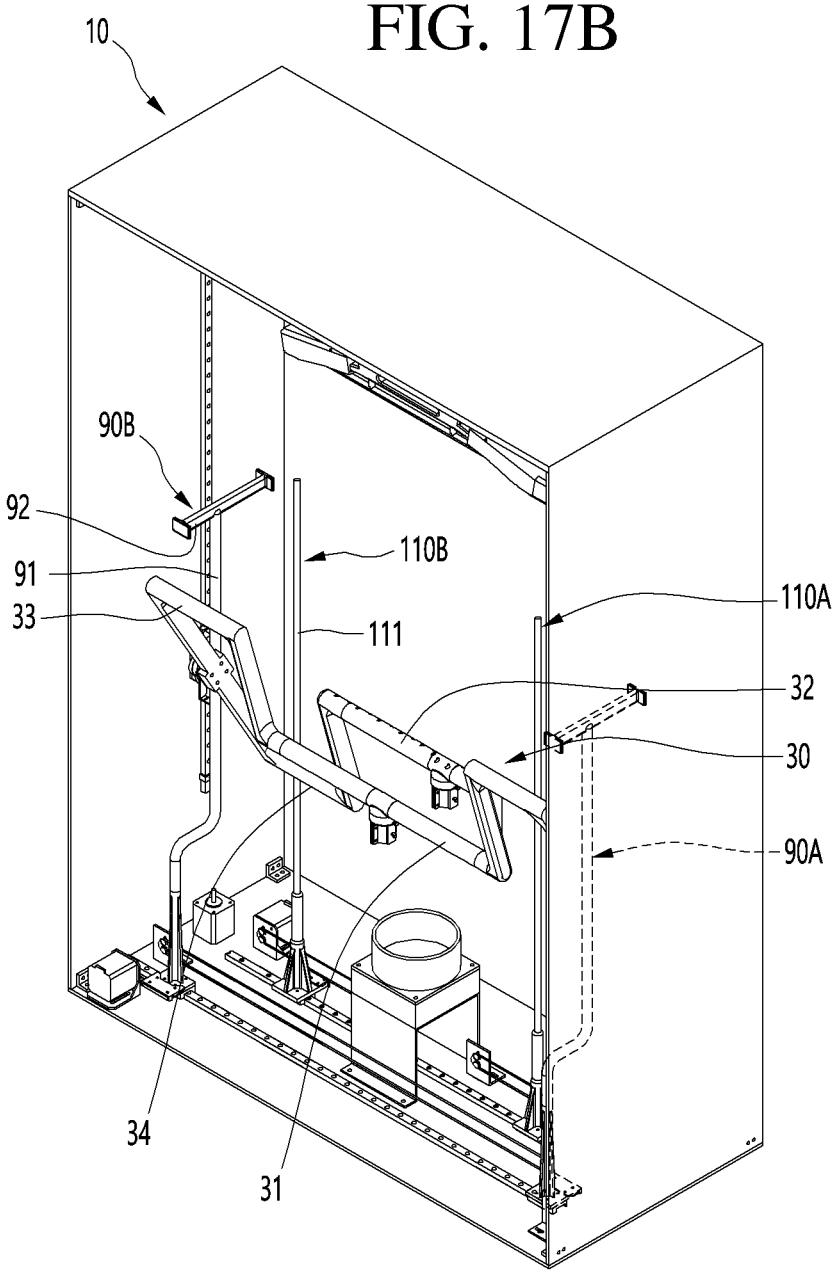

FIGS. 17A and 17B are views for explaining the operation of the separator and the spreader for refreshing the body of the clothing. In more detail, FIG. 17A is a view for explaining a positional relationship between clothing caught on a clothing supporter and a spreader and a separator, and FIG. 17B is a view for explaining a positional relationship between a separator, a spreader, and a steamer.

The pair of separators 90 may move in a direction away from each other to separate the arms C2 and C3 from the body C1 of the clothing C.

In more detail, the first separator 90A and the second separator 90B may move in a direction away from each other. The first separator 90A and the second separator 90B may move in opposite directions by the same distance from each other with respect to a virtual vertical plane passing through the holder 60. Accordingly, the clothing supporter 20 and the clothing C are not tilted, and the body C1 of the clothing C may droop downward.

Accordingly, in a state where both arms C2 and C3 of the clothing C are separated from the body C1, the distance L5 between the first separator 90A and the second separator 90B in the left and right direction may be greater than the distance L2 between the first separator 90A and the second separator 90B in the left and right direction immediately after moving between the body C1 and the arms C2 and C3 of the clothing C.

In this case, the first separator 90A may be located between the one front auxiliary body 33 and the one rear auxiliary body 34 (see FIG. 3), and the second separator 90B may be located between the other auxiliary body 33 and the other rear auxiliary body 34.

Accordingly, the body C1 of the clothing C may be located between the front steam body 31 and the rear steam body 32, and both arms C2 and C3 may be located between the front auxiliary body 33 and the rear auxiliary body 34 located opposite to each other.

Accordingly, in this state, when the steamer 30 elevates, the body C1 of the clothing C can be effectively refreshed without wrinkles by the steam sprayed from the front steam body 31 and the rear steam body 32. In addition, since both arms C2 and C3 of the clothing C are located between the front auxiliary body 33 and the rear auxiliary body 34, it can be prevented the risk that both arms C2 and C3 of the clothing C may not be refreshed in a wrinkled state and wrinkles thereof becomes severe.

Meanwhile, in the pair of spreaders 110, the tension part 111 extends upward and can be inserted into the body C1 of the clothing C and moves in directions away from each other to tension the body C1 of the clothing C tautly.

In more detail, the first spreader 110A may press one side of the body C1 to the outside, and the second spreader 110B may press the other side of the body C1 to the outside.

In this case, the distance L6 between the first spreader 110A and the second spreader 110B in the left and right direction may be closer than the distance L5 between the first separator 90A and the second separator 90B in the left and right direction.

Since the body C1 of the clothing C is located between the front steam body 31 and the rear steam body 32, the first spreader 110A and the second spreader 110B also may be located between the front steam body 31 and the rear steam body 32.

The steamer 30 may elevate in a state where the body C1 of the clothing C is spread taut by the spreader and may spray steam. Accordingly, wrinkles on the body C1 of the clothing C may be more effectively removed.

Figure 18:
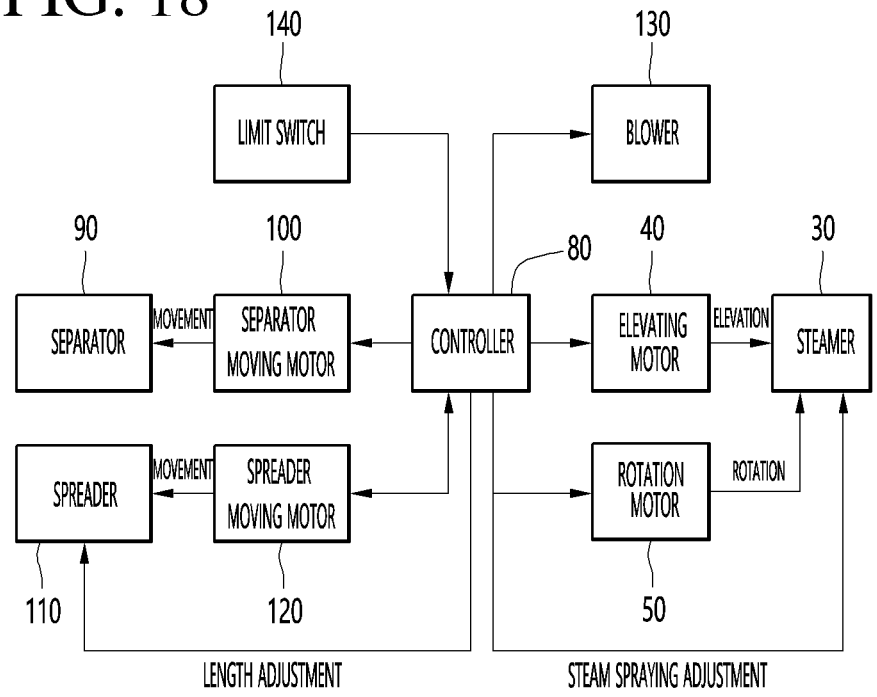
FIG. 18 is a control block view illustrating a clothing processing apparatus according to an embodiment of the present disclosure.

FIG. 18 is a control block view illustrating a clothing processing apparatus according to an embodiment of the present disclosure.

The controller 80 of the clothing processing apparatus according to the present embodiment may control the elevating motor 40, the rotation motor 50, the separator moving motor 100, the spreader moving motor 120, and the blower 130. It is apparent that the configuration controllable by the controller 80 may be added, removed, or changed.

The controller 80 may adjust the steam injection of the steamer 30.

The controller 80 may control the elevating motor 40 to elevate the steamer 30. Also, the controller 80 may control the rotation motor 50 to rotate the steamer 30. The controller 80 may simultaneously control the elevating motor 40 and the rotation motor 50 to combine elevating and rotating operations of the steamer 30 to spray steam onto the clothing C in various ways.

The controller 80 may control the separator moving motor 100 to move the separator 90 in the left and right direction.

In more detail, the controller 80 may move the first separator 90A and the second separator 90B in a direction away from each other from the initial position, and the first separator 90A and the second separator 90B may move between the body C1 and arms C2 and C3 of the clothing C.

Thereafter, the controller 80 separates one arm C2 of the clothing C from the body C1 by moving the first separator 90A and the second separator 90B in one direction to droop downward.

Alternatively, the controller 80 separates the other arm C3 of the clothing C from the body C1 by moving the first separator 90A and the second separator 90B in the other direction to droop downward.

Alternatively, the controller 80 may separate the arms C2 and C3 of the clothing C from the body C1 by moving the first separator 90A and the second separator 90B away from each other.

Meanwhile, the controller 80 may adjust the length of the spreader 110. In more detail, the controller 80 may extend or reduce the length of the tension part 111 of the spreader 110 in the vertical direction.

The controller 80 may extend the first separator 90A and the second separator 90B to be inserted into the body C1 of the clothing C.

The controller 80 may control the spreader moving motor 120 to move the spreader 110 in the left and right direction.

The controller 80 may move the first spreader 110A and the second spreader 1106 away from each other in a state where the first spreader 110A and the second spreader 1106 are inserted into the body C1 of the clothing C. Accordingly, the body C1 of the clothing C may be tensioned tautly.

The controller 80 may receive a load applied to the spreader moving motor 120. The controller 80 may stop the movement of the spreader 110 when the load is greater than or equal to a set value. Accordingly, it is possible to adjust the appropriate movement distance of the spreader 110 according to the size of the clothing C.

The controller 80 may control the on/off of the blowing fan 131. In a case where the blowing fan 131 is an inverter blowing fan, the controller 80 may control the rotation speed of the blowing fan 131.

The controller 80 may turn on the blower 130 so that the body C1 of the clothing C is opened by the wind.

Meanwhile, the controller 80 may receive the detection value of the limit switch 140. When the limit switch 140 is turned on, the controller 80 may stop the rotation motor 50 and set this state to the initial angle of the steamer 30.

Figure 19:
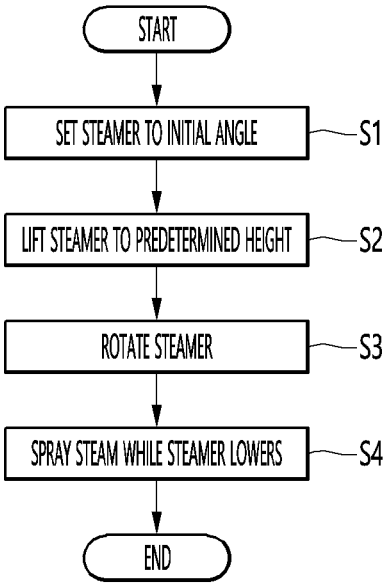
FIG. 19 is a flowchart illustrating a method for scanning clothing by a steamer according to an embodiment of the present disclosure.

FIG. 19 is a flowchart illustrating a method for scanning clothing by a steamer according to an embodiment of the present disclosure.

A method for controlling a clothing processing apparatus according to an embodiment of the present disclosure may include a preparation step S1 of setting an initial angle of the steamer 30, and a scanning step S2, S3, and S4 in which the steamer 30 scans the clothing C.

In the preparation step S1, the controller 80 may control the rotation motor 50 to rotate the steamer 30 until the limit switch 140 is pressed. When the steamer 30 presses the limit switch 140, the controller 80 may stop the rotation motor 50, and set the current state to the initial angle of the steamer 30.

The scanning step may include a lifting step S1 in which the steamer 30 including the front steam body 31 and the rear steam body 32 located opposite to each other with the clothing C interposed therebetween is raised to a predetermined height S1.

In more detail, during the raising step S2, the controller 80 may control the elevating motor 40 to raise the steamer 30 to a height corresponding to the upper portion of the clothing C.

The scanning step may include a rotation step S3 in which the steamer 30 rotates so that the front steam body 31 is in contact with the front surface of the clothing C and the rear steam body 32 is in contact with the rear surface of the clothing C.

In more detail, in the rotation step S3, the controller 80 may control the rotation motor 50 to rotate the steamer 30 by a predetermined angle. In this case, the front steam body 31 may be in contact with the upper front surface of the clothing C, and the rear steam body 32 may be in contact with the upper rear surface of the clothing C. In addition, at least a part of the front steam body 31 and the rear steam body 32 may overlap in the vertical direction.

The scanning step may include a lowering step S4 in which the steamer 30 lowers and sprays steam in a state where the front steam body 31 and the rear steam body 32 are in contact with the clothing C.

In more detail, in the lowering step S4, the controller 80 controls the elevating motor 40 so that the steamer 30 lowers and steam is sprayed from the steam spraying part 39 of the steamer 30 at the same time in a state where the front steam body 31 and the rear steam body 32 are in contact with the upper part of the clothing C.

In other words, the upper portion of the clothing C may be taut by applying mechanical force downward by the steamer 30 in a state of being supported by the clothing supporter 20, and in this state, at the front steam body 31 and the rear steam body 32, steam may be sprayed to perform ironing. Accordingly, wrinkles or folds of the clothing C can be effectively removed.

Figure 20:
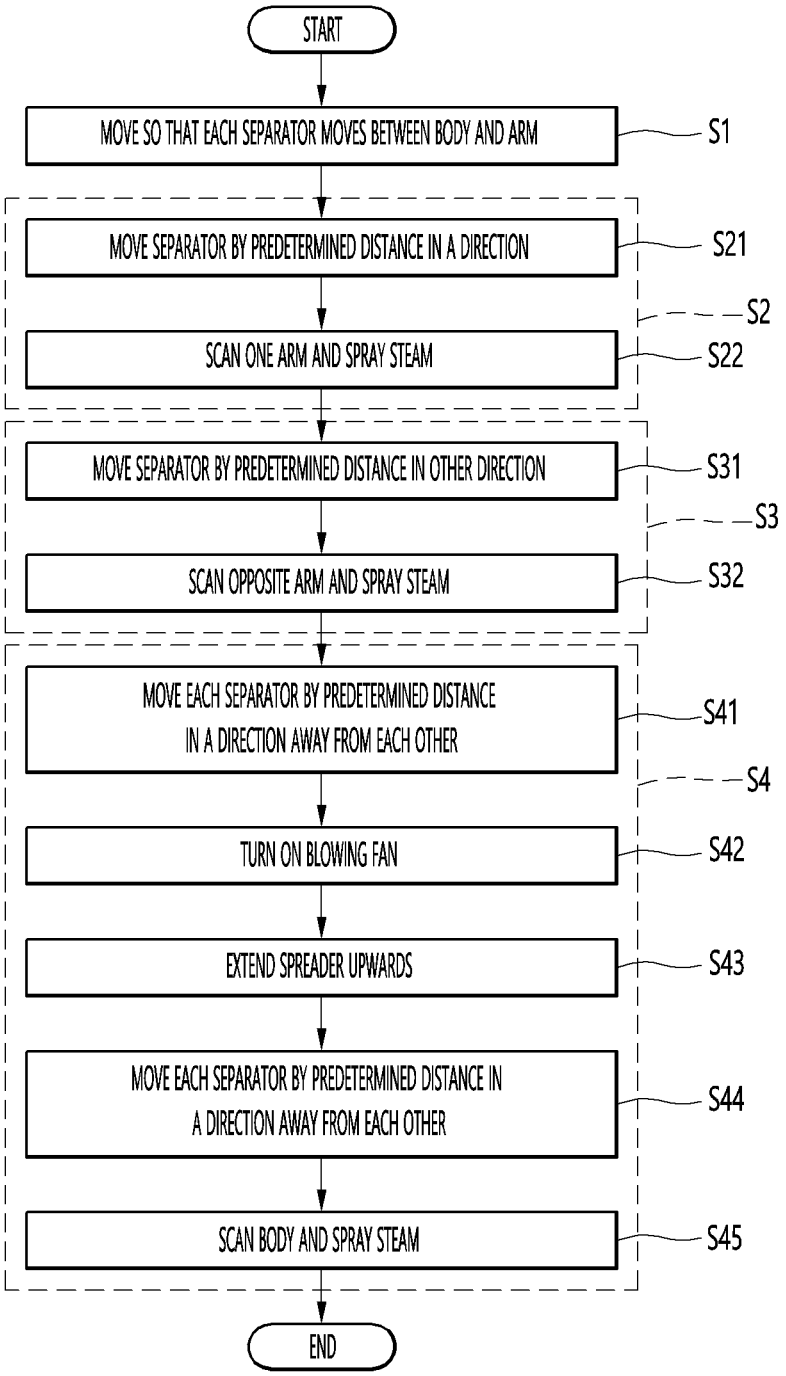
FIG. 20 is a flowchart illustrating an example of a method for controlling a clothing processing apparatus according to an embodiment of the present disclosure.

FIG. 20 is a flowchart illustrating an example of a method for controlling a clothing processing apparatus according to an embodiment of the present disclosure.

Hereinafter, a method for controlling the clothing processing apparatus according to the present embodiment will be described. The following control method may be performed in a state where the clothing supporter 20 on which the clothing C is hung is held on the holder 60.

The method for controlling the clothing processing apparatus according to the present embodiment may include a separation step S10, a first arm refreshing step S20, a second arm refreshing step S30, and a body refreshing step S40.

The separation step S10, the first arm refreshing step S20, the second arm refreshing step S30, and the body refreshing step S40 may be sequentially performed. This is because wrinkles may occur on the body C1 of the clothing C in the first arm refreshing step S20 and the second arm refreshing step S30.

In the separation step S10, the controller 80 controls the separator moving motor 100, and thus the first separator 90A and the second separator 90B can be moved in the opposite direction so that the first separator 90A and the second separator 90B, which were in the initial positions, are moved between the body C1 and the arm C2 and C3 of the clothing C. In this case, the first separator 90A can be moved between the body C1 and one of the arms C2 of the clothing C, and the second separator 90B can be moved between the body C1 and the other arm C3 of the clothing C.

The first arm refreshing step S20 may include a first arm alignment step S21 and a first arm scanning step S22.

In the first arm alignment step S21, the controller 80 may control each separator moving motor 100 to move the first separator 90A and the second separator 90B in one direction. In this case, one arm C2 of the clothing C may be separated from the body C1 to droop downward.

The first arm scanning step S22 may be performed after the first arm alignment step S21. The first arm scanning step S22 may correspond to the scanning steps S2, S3, and S4 described above with reference to FIG. 19.

In more detail, the first arm scanning step S22 may include a lifting step in which the steamer 30 including the front steam body 31 and the rear steam body 32 located opposite to each other with one arm C2 of the clothing C interposed therebetween is raised to a predetermined height; a rotation step of rotating the steamer 30 so that the front steam body 31 may include a lifting step in which the steamer 30 including the front steam body 31 and the rear steam body 32 located opposite to each other with one arm C2 of the clothing C interposed therebetween is raised to a predetermined height; a rotation step in which the steamer 30 rotates so that the front steam body 31 is in contact with the front surface of the one arm C2 and the rear steam body 32 is in contact with the rear surface of the one arm C2; and a lowering step in which the steamer 30 lowers and sprays steam in a state where the front steam body 31 and the rear steam body 32 are in contact with one arm C2.

Accordingly, the steamer 30 may refresh by scanning the one arm C2 which droops downward.

The second arm refreshing step S30 may include a second arm alignment step S31 and a second arm scanning step S32.

In the second arm alignment step S31, the controller 80 may control each separator moving motor 100 to move the first separator 90A and the second separator 90B in other directions. In this case, the other arm C3 of the clothing C may be separated from the body C1 to droop downward.

The second arm scanning step S32 may be performed after the second arm alignment step S31. The second arm scanning step S32 may correspond to the scanning steps S2, S3, and S4 described above with reference to FIG. 19.

In more detail, the second arm scanning step S32 may include a lifting step in which the steamer 30 including the front steam body 31 and the rear steam body 32 located opposite to each other with the other arm C3 of the clothing C interposed therebetween is raised to a predetermined height; a rotation step of rotating the steamer 30 so that the front steam body 31 is in contact with the front surface of the other arm C3 and the rear steam body 32 is in contact with the rear surface of the other arm C3; and a lowering step in which the steamer 30 lowers and sprays steam while the front steam body 31 and the rear steam body 32 are in contact with the other arm C3.

Accordingly, the steamer 30 may refresh while scanning the other arm C3 which droops downward.

The body refreshing step S40 may include a body alignment step S41, a blowing step S42, an insertion step S43, a tension step S44, and a body scanning step S45.

In the body alignment step S41, the controller 80 may control the separator moving motor 100 to move the first separator 90A and the second separator 90B in a direction away from each other. In this case, the body C1 of the clothing C may be separated from the arms C2 and C3 to droop downward.

The blowing step S42 may be performed after the body alignment step S41. In the blowing step S42, the controller 80 may turn on the blowing fan 131. In this case, the wind generated by the blowing fan 131 may be directed upward and the body C1 of the clothing C may be opened by the wind.

The insertion step S43 may be performed simultaneously with the blowing step S42 or may be performed after the blowing step S42. The controller 80 may extend the spreader 110 in a state where the blowing fan 131 is turned on and insert it into the body C1 of the clothing C. When the extension of the spreader 110 is completed, the controller 80 may turn off the blowing fan 131.

The tension step S44 may be performed after the insertion step S43. In the tension step S44, the controller 80 may control the spreader moving motor 120 to move the pair of spreaders 110 by a predetermined distance in a direction away from each other. Accordingly, the body C1 of the clothing C may be tensioned tautly.

Also, the controller 80 may stop the movement of the spreader 110 when the load applied to the spreader moving motor 120 is greater than or equal to a set value. Accordingly, it is possible to adjust the appropriate movement distance of the spreader 110 according to the size of the clothing C.

The body scanning step S45 may be performed after the tension step S44. The body scanning step S45 may correspond to the scanning steps S2, S3, and S4 described above with reference to FIG. 19.

In more detail, the body scanning step S45 may include a lifting step of lifting the steamer 30 including the front steam body 31 and the rear steam body 32 positioned opposite to each other with the body C1 of the clothing C interposed therebetween to a predetermined height; a rotation step in which the steamer 30 rotates so that the front steam body 31 is in contact with the front surface of the body C1 and the rear steam body 32 is in contact with the rear surface of the body C1; and a lowering step in which the steamer 30 lowers and sprays steam in a state where the front steam body 31 and the rear steam body 32 are in contact with the body C1.

Accordingly, the steamer 30 may refresh the body C1 which droops downward while scanning.

According to a preferred embodiment of the present disclosure, a mechanical force can be applied to the clothing in a simple manner in which the steamer rotates, and the steamer lowers and sprays steam in a state where the clothing is kept taut by the mechanical force. Accordingly, folds and wrinkles of the clothing can be minimized.

In addition, since the steamer lowers in a state where the front steam body and the rear steam body at least partially overlap in the vertical direction, the steamer can reliably apply mechanical force to the clothing.

In addition, since the steamer performs both tensioning and steam spraying of clothing, the configuration of the clothing treating apparatus can be simplified and the clothing treating apparatus can be compact.

In addition, since steam is sprayed while the steamer is in contact with the clothing, the clothing refreshing performance can be maximized.

In addition, since the alignment of the body and arms of the clothing, the application of mechanical force, and the steam spraying are automatically performed, there is an advantage in that the user's convenience is increased.

In addition, since the steamer has a single closed curve shape, clothing may not deviate from the inside of the steamer.

In addition, the steam injector may be rotatably fastened to the front steam body and the rear steam body. Accordingly, even if the steamer rotates within a certain range, the steam injector may be directed downward by the load. Accordingly, it is possible to prevent the steam hose connected to the steam injector from being tangled or twisted.

In addition, the steam injector may be fastened to the central portion of the front steam body and the rear steam body. Accordingly, the steam pressure required for the steam injected into the steam injector to move to each steam injector may be reduced.

In addition, when the steamer rotates a certain range or more, the stopper protrusion of the steam injector may be caught on the end portion of the stopper groove of the steamer, and the steam injector may rotate together with the steamer. Accordingly, it is possible to prevent the steam injector 30A or the steam hose connected thereto from interfering with the clothing C.

In addition, in a case where one arm of the clothing droops downward and passes between the front steam body and the rear steam body, the body and the other arm of the clothing separated by the separator pass through between the front auxiliary body and the rear auxiliary body of the steamer. In this state, when the steamer scans, only one arm may be ironed, and the body and the other arm may not be ironed. Accordingly, there is an advantage that wrinkles do not occur in the portion where one arm overlaps the body, and the body and the other arm are not ironed in a crumpled state.

In addition, the rotation motor may be connected to the central portion of the outer connection part. Accordingly, the steamer can rotate smoothly by the rotational force of the rotation motor.

In addition, the front and rear distance between the front auxiliary body and the rear auxiliary body may be greater than the front and rear distance between the front steam body and the rear steam body. Accordingly, the body and the other arm of the clothing separated by the separator can smoothly move between the front steam body and the rear steam body, and the occurrence of wrinkles can be minimized.

In addition, the elevation of the steamer may be guided by the guide bar and the guide block. Accordingly, the operation reliability of the clothing processing apparatus may be improved.

In addition, when the steamer presses the limit switch, the steamer's rotation may be stopped. This makes it easy to set the initial angle of the steamer.

What is claimed is:

1. A clothing processing apparatus comprising:

a cabinet having a receiving space formed therein, in which clothing is received;

a holder configured to be located in the receiving space to hold a clothing supporter configured to support the clothing;

a steamer configured to spray steam toward the clothing while locating inside the receiving space;

a rotation motor configured to rotate the steamer so that the steamer is in contact with the clothing; and an elevating motor configured to elevate the steamer in a state where the steamer is in contact with the clothing;

wherein the steamer includes:

a front steam body formed long in a left and right direction and in contact with a front surface of the clothing; and a rear steam body spaced apart from the front steam body, formed long in the left and right direction, and in contact with a rear surface of the clothing, and wherein the elevating motor lowers the steamer in a state where at least a portion of the front steam body and the rear steam body overlaps each other in a vertical direction.

2. The clothing processing apparatus of claim 1, wherein the steamer has a single closed curve shape.

3. The clothing processing apparatus of claim 1, wherein a plurality of steam spraying parts are formed on the front steam body and the rear steam body.

4. The clothing processing apparatus of claim 1, wherein a steam injector into which steam is injected is rotatably fastened to the front steam body and the rear steam body.

5. The clothing processing apparatus of claim 4, wherein stopper grooves having a predetermined length in a circumferential direction are formed on the front steam body and the rear steam body, and wherein the steam injector has a stopper protrusion configured to move in the stopper groove.

6. The clothing processing apparatus of claim 1, wherein steam injectors are fastened to central portions of the front steam body and the rear steam body.

7. The clothing processing apparatus of claim 1, wherein the steamer further includes:

a front connection part formed long in a forward inclined direction from an end portion of the front steam body;

a rear connection part formed long in a direction parallel to the front connection part from an end portion of the rear steam body;

a front auxiliary body formed long from an end portion of the front connection part toward a side surface of the cabinet;

a rear auxiliary body formed long from an end portion of the rear connection part toward the side surface of the cabinet; and an outer connection part configured to connect end portions of the front auxiliary body and the rear auxiliary body.

8. The clothing processing apparatus of claim 7, wherein the front connection part and the rear connection part are formed to be steeper than the outer connection part.

9. The clothing processing apparatus of claim 7, wherein the rotation motor is connected to a central portion of the outer connection part.

10. The clothing processing apparatus of claim 7, wherein a front and rear distance between the front auxiliary body and the rear auxiliary body is greater than a front and rear distance between the front steam body and the rear steam body.

11. A clothing processing apparatus comprising:

a cabinet having a receiving space formed therein, in which clothing is received;

a holder configured to be located in the receiving space to hold a clothing supporter configured to support the clothing;

a steamer configured to spray steam toward the clothing while locating inside the receiving space;

a rotation motor configured to rotate the steamer so that the steamer is in contact with the clothing; and an elevating motor configured to elevate the steamer in a state where the steamer is in contact with the clothing;

a guide bar configured to be fixed long inside the cabinet in a vertical direction to guide an elevation of the steamer;

a guide block having a groove into which the guide bar is fitted formed therein; and a rotation motor bracket configured to be fastened to the guide block and to be mounted with the rotation motor, wherein the steamer includes:

a front steam body formed long in a left and right direction and in contact with a front surface of the clothing; and a rear steam body spaced apart from the front steam body, formed long in the left and right direction, and in contact with a rear surface of the clothing.

12. The clothing processing apparatus of claim 11, wherein a coupler passing hole is formed in the rotation motor bracket through which a coupler connecting the rotation motor and the steamer passes.

13. The clothing processing apparatus of claim 11, further comprising:

a lead screw configured to be disposed long in an inner portion of the cabinet in the vertical direction and to be connected to the rotation motor, wherein a screw hole through which the lead screw passes is formed on the rotation motor bracket.

14. The clothing processing apparatus of claim 1, further comprising:

a guide bar configured to be fixed long inside the cabinet in the vertical direction to guide an elevation of the steamer;

a guide block having a groove into which the guide bar is fitted formed therein; and a connector configured to be fastened to the guide block and to which the steamer is rotatably connected.

15. The clothing processing apparatus of claim 14, further comprising:

a limit switch configured to be mounted on the connector and to be pressed by the steamer.

16. The clothing processing apparatus of claim 15, further comprising:

a controller configured to stop the rotation motor when the steamer presses the limit switch.

17. A method for controlling a clothing processing apparatus, comprising:

a lifting step in which a steamer including a front steam body and a rear steam body positioned opposite to each other with clothing interposed therebetween is lifted to a predetermined height;

a rotation step in which the steamer rotates so that the front steam body is in contact with a front surface of the clothing and the rear steam body is in contact with a rear surface of the clothing; and a lowering step in which the steamer sprays steam while lowering in a state where the front steam body and the rear steam body are in contact with the clothing, wherein, in the lowering step, at least a portion of the front steam body and the rear steam body overlaps in a vertical direction.

18. The method for controlling a clothing processing apparatus of claim 17, further comprising:

a preparatory step which is carried out before the lifting step which rotates the steamer until a limit switch is pressed.

* * * * *